US006732540B2

(12) United States Patent
Sugihara et al.

(10) Patent No.: US 6,732,540 B2
(45) Date of Patent: May 11, 2004

(54) AIR CONDITIONING PLANT AND CONTROL METHOD THEREOF

(75) Inventors: Yoshibumi Sugihara, Chiyoda-ku (JP); Yuuji Miyajima, Chiyoda-ku (JP); Takumi Sugiura, Chiyoda-ku (JP); Hiroo Sakai, Chiyoda-ku (JP); Noboru Oshima, Chiyoda-ku (JP); Tadakatsu Nakajima, Tsuchiura (JP); Hiroshige Kikuchi, Tsuchiura (JP)

(73) Assignee: Hitachi Plant Engineering & Construction Co., Ltd., Tokyo (JP)

( * ) Notice: Subject to any disclaimer, the term of this patent is extended or adjusted under 35 U.S.C. 154(b) by 0 days.

(21) Appl. No.: 10/322,606

(22) Filed: Dec. 19, 2002

(65) Prior Publication Data

US 2004/0011066 A1 Jan. 22, 2004

(30) Foreign Application Priority Data

Jul. 19, 2002 (JP) ..... 2002-210875

(51) Int. Cl.[7] ..... F25D 17/00; G01M 1/38; G05B 13/00; F24F 3/00

(52) U.S. Cl. ..... 62/177; 62/180; 700/276; 165/209

(58) Field of Search ..... 62/177, 132, 178, 62/180, 185; 700/276, 211, 42, 83; 165/205, 208, 209, 212, 222

(56) References Cited

U.S. PATENT DOCUMENTS

| | | | | | |
|---|---|---|---|---|---|
| 4,955,205 | A | * | 9/1990 | Wilkinson | 62/94 |
| 5,600,960 | A | * | 2/1997 | Schwedler et al. | 62/99 |
| 5,988,517 | A | * | 11/1999 | Bauer et al. | 236/49.3 |
| 6,257,007 | B1 | * | 7/2001 | Hartman | 62/183 |
| 6,408,228 | B1 | * | 6/2002 | Seem et al. | 700/276 |
| 6,415,617 | B1 | * | 7/2002 | Seem | 62/186 |
| 6,427,461 | B1 | * | 8/2002 | Whinery et al. | 62/176.6 |

FOREIGN PATENT DOCUMENTS

JP 2002-098358 4/2002

* cited by examiner

*Primary Examiner*—William C. Doerrler
(74) *Attorney, Agent, or Firm*—Nixon Peabody LLP; David S. Safran

(57) ABSTRACT

Provided are an air conditioning plant control method by which an air conditioning plant can be operated in a most desirable state, and an air conditioning plant so controlled. An air conditioning plant is controlled, which has at least one air conditioner, a refrigerating machine supplying cold water to the air conditioner and a cooling tower supplying cooling water to the refrigerating machine. Within an extent satisfying set conditions of air conditioning, setpoints of the draft temperature of the at least one air conditioner, the cold water temperature of the refrigerating machine and the temperature of cooling water from the cooling tower are altered and optimized so as to minimize energy consumption, operating cost or carbon dioxide emission of the air conditioning plant.

12 Claims, 15 Drawing Sheets a: CONTROL OF HEAT SOURCE/
SINK TEMPERATURE
b: CONTROL OF HEAT DISCHARGING/
ABSORBING MEDIUM PUMP FLOW RATE
c: CONTROL OF LOW/HIGH-TEMPERATURE
HEAT GENERATOR TEMPERATURE
d: CONTROL OF LOW/HIGH-TEMPERATURE
HEAT PUMP FLOW RATE
e: CONTROL OF BLOWER FLOW RATE
f: INDIVIDUAL CONTROL BY PRIOR ART

AIR CONDITIONING PLANT AND CONTROL METHOD THEREOF

BACKGROUND OF THE INVENTION

1. Field of the Invention

The present invention relates to an air conditioning plant and a control method thereof, and more particularly to an air conditioning plant capable of optimal operation optimized with a view to energy conservation, operating cost reduction and conservation of the global environment and a control method thereof.

2. Description of the Related Art

Japanese Patent Application Publication No. 2002-98358 discloses a primary pump type heat source current transformation system which air-conditions a building by supplying in a circulatory manner cold or hot water from only a heat source side. This system comprises a cold/hot water generator which supplies cold or hot water to an air conditioner, a cooling tower which supplies cooling water to the cold/hot water generator, and a pumping variable flow rate control unit which performs variable control so as to supplying in a circulatory manner the cold or hot water and the cooling water according to the air conditioning load, and the power consumption by a cooling water pump and a cold water pump is reduced by varying the flow rates of the cold or hot water and the cooling water.

However, as the air conditioning method disclosed in Japanese Patent Application Publication No. 2002-98358 is to reduce the power consumption by the cooling water pump and the cold water pump by varying only the flow rates of the cold or hot water and the cooling water, the control is not designed to reduce the overall power consumption by the air conditioning plant, and accordingly it is not possible to reduce power consumption by the whole air conditioning plant.

SUMMARY OF THE INVENTION

An object of the present invention, attempted in view of the circumstances noted above, is to provide an air conditioning plant capable of reducing the whole energy consumption, the operating cost or the carbon dioxide emission of the whole air conditioning plant and a control method thereof.

In order to attain the object stated above, the present invention is directed to a control method of an air conditioning plant having at least one air conditioner, a low/high-temperature heat generator which supplies a low/high-temperature heat transfer medium to the air conditioner, and a heat source/sink which supplies a heat discharging/absorbing medium to the low/high-temperature heat generator, whereby the setpoints of at least the draft temperature of the at least one air conditioner, the low/high-temperature heat transfer medium temperature of the low/high-temperature heat generator and the heat discharging/absorbing medium temperature of the heat source/sink are optimized so as to reduce at least one of the energy consumption, the operating cost and the carbon dioxide emission of the air conditioning plant within the extent of satisfying the set conditions of air conditioning.

The present invention is also directed to an air conditioning plant having at least one air conditioner, a low/high-temperature heat generator which supplies a low/high-temperature heat transfer medium to the air conditioner, and a heat source/sink which supplies a heat discharging/absorbing medium to the low/high-temperature heat generator, wherein the setpoints of at least the draft temperature of the at least one air conditioner, the low/high-temperature heat transfer medium temperature of the low/high-temperature heat generator and the temperature of the heat discharging/absorbing medium from the heat source/sink can be optimized so as to reduce the energy consumption, the operating cost or the carbon dioxide emission of the air conditioning plant within the extent of satisfying the set conditions of air conditioning.

The present invention is also directed to a control method of an air conditioning plant comprising at least one air conditioner, at least one low/high-temperature heat generators which supply a low/high-temperature heat transfer medium to the air conditioner, a heat source/sink which cools or heats the low/high-temperature heat generator, a low/high-temperature heat accumulator which stores the low/high-temperature heat transfer medium during a period of a low low/high-temperature heat load, heat transfer medium conveying units, such as pumps, fans and blowers, which connect the aforementioned devices, and control units which control the temperatures of heat generated by these devices and/or the flow rate of conveying the heat transfer medium, further provided with a group of measuring instruments with which data representing the operating states of individual units including the temperature and the flow rate are measured, a group of control units with which the operation of individual units is controlled, and a central monitoring device which is linked by signal lines to the group of measuring instruments and the group of control units, wherein the central monitoring device has, built into it, at least either an air conditioning plant operation simulator which manages the operation of the whole air conditioning plant or an air conditioning plant operational data table; computes on the basis of real time operational data picked up by the measuring instruments the optimal operating temperature and the optimal flow rate for the constituent units of the air conditioning plant and the optimal number of operating units of at least one of the low/high-temperature heat generators to minimize the energy consumption, operating cost or carbon dioxide emission equivalent or any indicator combining two or more of these factors of the whole air conditioning plant in predetermined ranges of conditions, including the temperature and humidity, of air conditioning, ranges of energy consumption conditions with respect to electric power, fuel, water and so forth, or various permissible areas of condition setting which satisfy the ranges of requirements set by combining these two sets of conditions in a prioritized manner; and supplies those optimal values to the group of control units as control setpoints, and the control unit group generates control signals on the basis of the control setpoints, supplies the control signals to the constituent units of the air conditioning plant or to the pertinent control units themselves to control at least two of the constituent units of the air conditioning plant at substantially the same time.

The present invention is also directed to a control method of an air conditioning plant comprising at least one air conditioner, at least one low/high-temperature heat generators which supply a low/high-temperature heat transfer medium to the air conditioner, a heat source/sink which cools or heats the low/high-temperature heat generator, heat transfer medium conveying units, such as pumps, fans and blowers, which connect the aforementioned devices, and control units which control the temperatures of heat generated by these devices and/or the flow rate of conveying the heat transfer medium, a group of measuring instruments with which data representing the operating states of individual units including the temperature and the flow rate are measured, a group of control units with which the operation of individual units is controlled, and a central monitoring device which is linked by signal lines to the group of measuring instruments and the group of control units, wherein the central monitoring device has, built into it, at least either an air conditioning plant operation simulator which manages the operation of the whole air conditioning plant or an air conditioning plant operational data table; computes on the basis of real time operational data picked up by the measuring instruments the optimal operating temperature and the optimal flow rate for the constituent units of the air conditioning plant and the optimal number of operating units of at least one of the low/high-temperature heat generators to minimize the energy consumption, operating cost or carbon dioxide emission equivalent or any indicator combining two or more of these factors of the whole air conditioning plant in predetermined ranges of conditions, including the temperature and humidity, of air conditioning, ranges of energy consumption conditions with respect to electric power, fuel, water and so forth, or various permissible areas of condition setting which satisfy the ranges of requirements set by combining these two sets of conditions in a prioritized manner; and supplies those optimal values to the group of control units as control setpoints, and the control unit group generates control signals on the basis of the control setpoints, and supplies the control signals to the constituent units of the air conditioning plant or to the pertinent control units themselves to control at least two of the constituent units of the air conditioning plant at substantially the same time.

The present invention is also directed to an air conditioning plant which performs air conditioning by supplying a low/high-temperature heat transfer medium in a circulatory manner, provided with simulation models of low/high-temperature heat generators, pumps and other units constituting the air conditioning plant, wherein optimal control targets to minimize or maximize a performance criterion are determined by simulation, and the air conditioning plant is operated according to the optimal control targets.

The present invention is also directed to an air conditioning plant which performs air conditioning by supplying a low/high-temperature heat transfer medium in a circulatory manner, provided with an equipment characteristics database which stores characteristics data on constituent units of the air conditioning plant, an air conditioning plant simulator which computes power consumptions and fuel consumptions in partial loads from the equipment characteristics data of constituent units stored in the equipment characteristics database, and computes performance functions by using conversion coefficients, and an optimizing device which computes the optimal control targets for the constituent units of the air conditioning plant by using the air conditioning plant simulator, wherein the constituent units of the air conditioning plant are operated according to the optimal control targets.

According to the present invention, so that an air conditioning plant can be operated in the most desirable state, the setpoints of the draft temperature of least one air conditioner, the low/high-temperature heat transfer medium temperature of a low/high-temperature heat generator and the temperature of the heat discharging/absorbing medium from a heat source/sink can be optimized. Thus, the inventors of the present invention discovered, as a result of analyzing these three parameters, that the air conditioning plant could be operated in a highly desirable state. This makes possible simple and prompt accomplishment of efficient operation of the air conditioning plant.

According to the present invention, it is preferable to optimize at least one of the setpoints of the draft air flow rate of the air conditioner, the low/high-temperature heat transfer medium flow rate of the low/high-temperature heat generator and the flow rate of the heat discharging/absorbing medium from the heat source/sink in addition to the draft temperature of the at least one air conditioner, the low/high-temperature heat transfer medium temperature of the low/high-temperature heat generator and the temperature of the heat discharging/absorbing medium from the heat source/sink. By adding more parameters to the aforementioned controls, it is made possible to control the operation of the air conditioning plant with greater accuracy.

Further according to the present invention, it is preferable to prepare in advance a data table showing a plurality of combinations of the draft temperature of the at least one air conditioner, the low/high-temperature heat transfer medium temperature of the low/high-temperature heat generator and the temperature of the heat discharging/absorbing medium from the heat source/sink and the energy consumption, the operating cost or the carbon dioxide emission of the air conditioning plant at the time, and to alter setpoints by accessing this data table. If a data table is prepared in advance in this manner, prompt control the operation of the air conditioning plant is made possible.

Further according to the present invention, it is preferable that the piping conditions of the at least one air conditioner, the piping conditions of the low/high-temperature heat generator and the piping conditions of the heat source/sink can be entered. If the piping conditions of these units can be entered in this way, application to various air conditioning plants or when the air conditioning plant has been remodeled would be facilitated, resulted in an expanded range of applicability of the air conditioning plant and the control method therefor pertaining to the present invention. Incidentally, the piping conditions include the number of piping lines, the piping length, pipe bore, pressure loss and other factors of each unit.

Further according to the present invention, efficient operation of the air conditioning plant can also be accomplished simply and promptly in the air conditioning plant provided with a low/high-temperature heat accumulator which stores the low/high-temperature heat transfer medium in a period of a lighter low/high-temperature heat load in addition to the air conditioner, the low/high-temperature heat generator and the heat source/sink.

The present invention is also directed to an air conditioning plant comprising an air conditioner, a low/high-temperature heat generator and a heat source/sink further provided with a group of measuring instruments with which data representing the operating states of individual units including the temperature and the flow rate are measured, a group of control units with which the operation of individual units is controlled, and a central monitoring device which is linked by signal lines to the group of measuring instruments and the group of control units, wherein the central monitoring device has, built into it, at least either an air conditioning plant operation simulator which manages the operation of the whole air conditioning plant or an air conditioning plant operational data table; computes on the basis of real time operational data picked up by the measuring instruments the optimal operating temperature and the optimal flow rate for the constituent units of the air conditioning plant and the optimal number of operating units of at least one of the low/high-temperature heat generators to minimize the energy consumption, operating cost or carbon dioxide emission equivalent or any indicator combining two or more of these factors of the whole air conditioning plant in predetermined ranges of conditions, including the temperature and humidity, of air conditioning, ranges of energy consumption conditions with respect to electric power, fuel, water and so forth, or various permissible areas of condition setting which satisfy the ranges of requirements set by combining these two sets of conditions in a prioritized manner; and supplies those optimal values to the group of control units as control setpoints, and the control unit group generates control signals on the basis of the control setpoints, and supplies the control signals to the constituent units of the air conditioning plant or to the pertinent control units themselves to control at least two of the constituent units of the air conditioning plant at substantially the same time. Efficient operation of the air conditioning plant is thereby made possible simply and promptly.

Further according to the present invention, it is preferable that the central monitoring device has a unit which enters from outside the priority ranks or the minimization indicators, on the basis of and the various permissible areas of condition setting performs the minimizing computations, generates optimal control values and controls at least two of the constituent units of the air conditioning plant at substantially the same time, with the result that efficient operation of the air conditioning plant is thereby made possible simply and promptly.

Further according to the present invention, it is preferable that at least one of the units having devices which externally supply and display the energy consumption, the operating cost and the instantaneous value and the integrated value of the carbon dioxide emission equivalent of the whole air conditioning plant is provided with the central monitoring device.

The present invention is also directed to an air conditioning plant which performs air conditioning by supplying a low/high-temperature heat transfer medium in a circulatory manner comprising simulation models of low/high-temperature heat generators, pumps and other units constituting the air conditioning plant, wherein optimal control targets to minimize or maximize a performance criterion are determined by simulation, and the air conditioning plant is operated according to the optimal control targets. This makes possible prompt control of the operation of the air conditioning plant. Also, the performance criterion here is supposed to be the energy consumption, but it can as well be the operating coast or the carbon dioxide emission equivalent.

The present invention is also directed to an air conditioning plant which performs air conditioning by supplying a low/high-temperature heat transfer medium in a circulatory manner, comprising: an equipment characteristics database which stores characteristics data on constituent units of the air conditioning plant; an air conditioning plant simulator which computes power consumptions and fuel consumptions in partial loads from the equipment characteristics data of constituent units stored in the equipment characteristics database, and computes performance functions by using conversion coefficients; and an optimizing device which computes the optimal control targets for the constituent units of the air conditioning plant by using the air conditioning plant simulator, wherein the constituent units of the air conditioning plant are operated according to the optimal control targets. This makes possible prompt control of the operation of the air conditioning plant. Also, the performance criterion here is supposed to be the energy consumption, but it can as well be the operating coast or the carbon dioxide emission equivalent.

Further according to the present invention, it is preferable that there are provided a computer for computing optima, which determines optimal control targets to minimize or maximize a performance criterion by simulation, and a monitoring/control unit which receives optimal control targets from the computer for computing optima and performs monitoring and control to ensure that constituent units of the air conditioning plant operate without abnormality, wherein the processing period of the monitoring/control unit is shorter than that of the computer for computing optima, and the monitoring/control unit adjusts the control targets, in response to variations in the conditions of outside air, the temperature of cooling water, that of cold water and other factors, so that the operational limits of the units be not surpassed with reference to the optimal control targets determined by the computer for computing optima. More accurate control of the operation of the air conditioning plant is thereby made possible.

Further according to the present invention, it is preferable that parameters required for air conditioning plant simulation are identified on the basis of measurements by sensors, the air conditioning plant is simulated using the identified parameters, and the parameters to be identified and the resistance coefficients of piping are ducting. This makes possible even more accurate control of the operation of the air conditioning plant.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

An air conditioning plant and a control method thereof, which are preferred embodiments of the present invention, will be described below with reference to the accompanying drawings.

Figure 1:
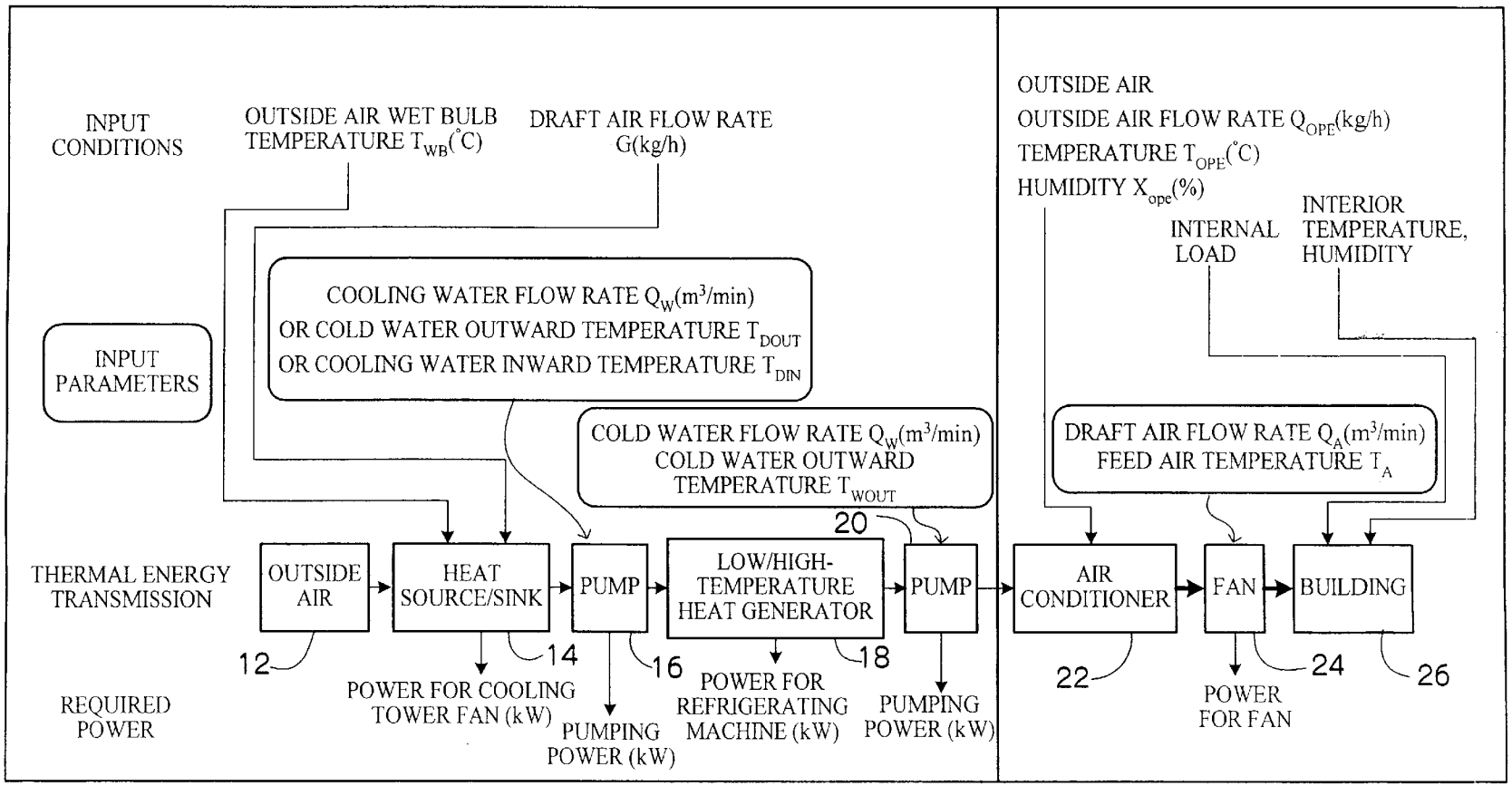
FIG. 1 is a block diagram illustrating a configuration of an air conditioning plant to which the first embodiment of the present invention is applied.

FIG. 1 is a block diagram illustrating a configuration of an air conditioning plant 10 to which the present invention is applied. In this block diagram, above each block are stated its input conditions and input parameters (enclosed), and below each block is stated the motive power it requires.

In the diagram, the transfer of thermal energy is shown to flow from left to right. The heat is transferred between outside air 12 and a heat source/sink 14, and heat discharging/absorbing medium from the heat source/sink 14 is supplied by heat discharging/absorbing medium pump 16 to low/high-temperature heat generator 18. Low/high-temperature heat transfer medium from low/high-temperature heat generator 18 is supplied by low/high-temperature heat transfer medium pump 20 to an air conditioner 22. Conditioned air from the air conditioner 22 is supplied by a fan 24 to a building 26.

Next, before describing an air conditioning plant control method according to the present invention (to be described with reference to FIG. 2) using the air conditioning plant 10 of FIG. 1, the relationships between various parameters to be set in the air conditioning plant 10 and the operating cost will be described.

Figure 3:
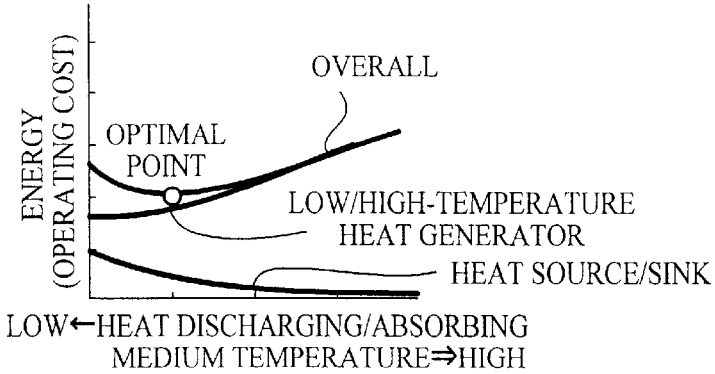
FIGS. 3 through 11 are graphs showing relationships between various parameters and the operating cost.
Figure 4:
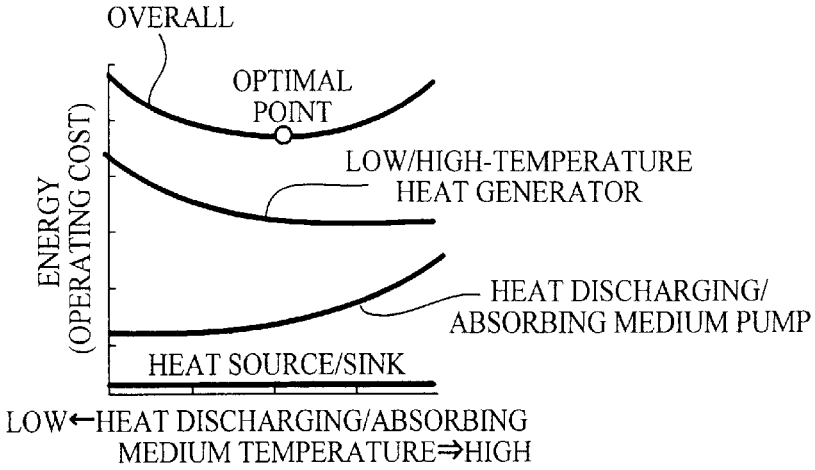
Figure 5:
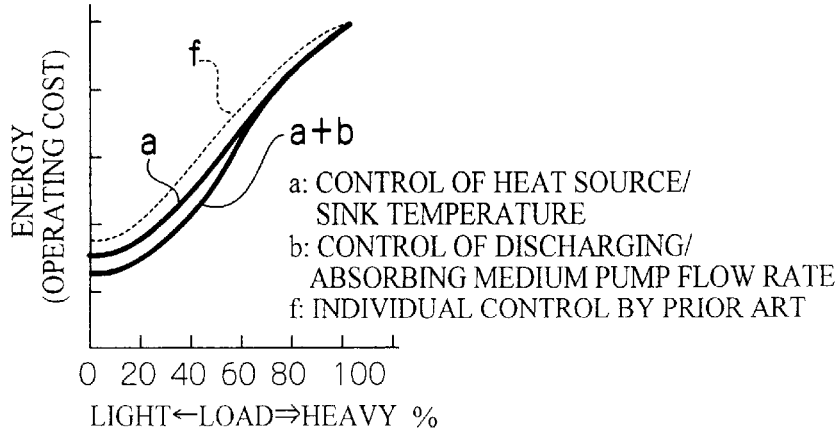

FIGS. 3 through 11 are graphs showing these relationships: FIG. 3 shows the impacts of a variation in the temperature of heat discharging/absorbing medium from the heat source/sink 14 on the overall operating cost and two other parameters; FIG. 4, the impacts of a variation in the flow rate of heat discharging/absorbing medium from the heat source/sink 14 on the overall operating cost and three other parameters; and in FIG. 5, the load is plotted on the horizontal axis to enable FIG. 3 and FIG. 4 to be discussed at the same time. Where the overall operating cost is minimized by regulating only the heat source/sink 14, the load-dependence of the overall operating cost is shown in FIG. 3. Further, where a variation in the flow rate of the heat discharging/absorbing medium pump 16 is also taken into account, the overall operating cost is FIG. 3+FIG. 4 as shown in FIG. 5. Incidentally, in the conventional way of control, as the heat source/sink 14 or the heat discharging/absorbing medium pump 16 is individually controlled to operate within its permissible limit, the overall operating cost increases as indicated by a dotted line in FIG. 5.

Figure 6:
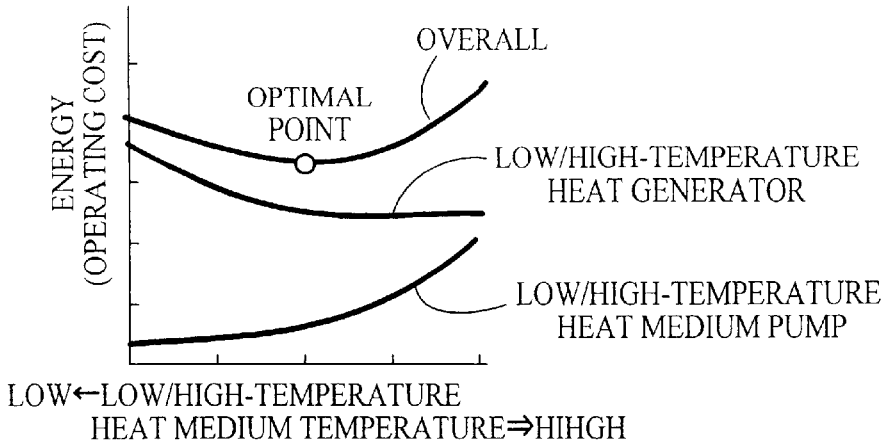
Figure 7:
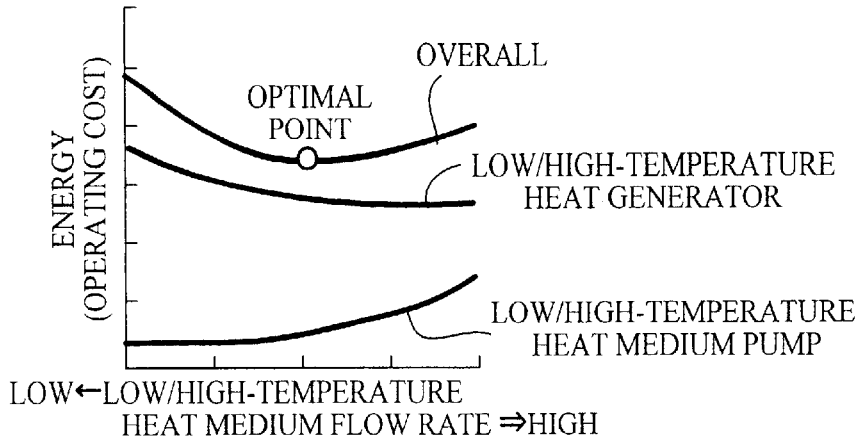

FIG. 6 shows the impacts of a variation in the temperature of the low/high-temperature heat transfer medium from the low/high-temperature heat generator 18 on the overall operating cost and two other parameters, and FIG. 7, the impacts of a variation in the flow rate of low/high-temperature heat transfer medium from the low/high-temperature heat generator 18 on the overall operating cost and two other parameters.

Figure 8:
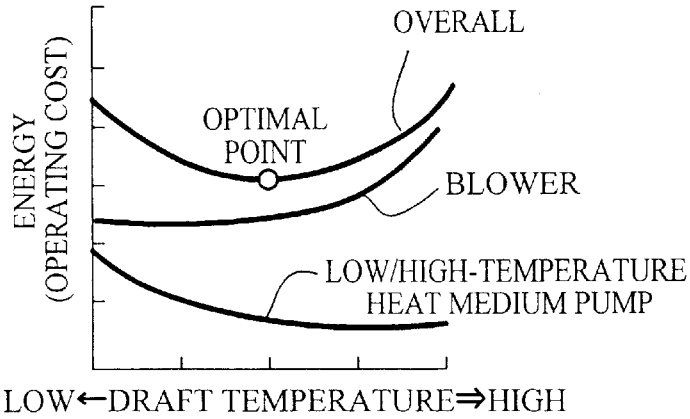
Figure 9:
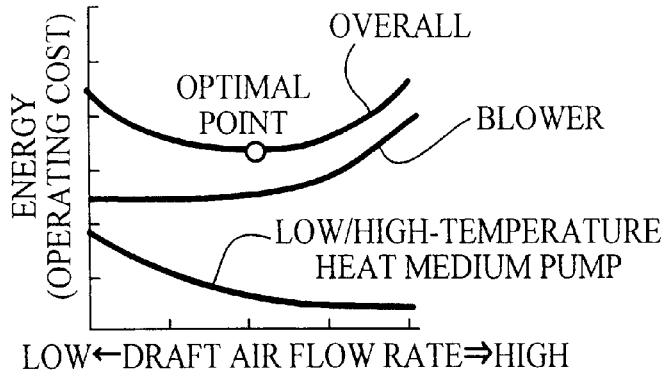
Figure 10:
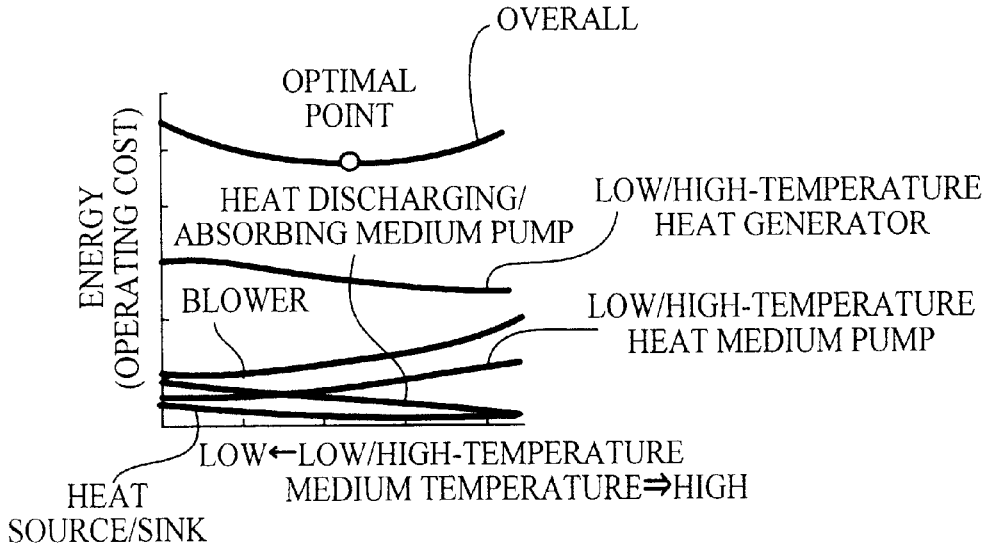

FIG. 8 shows the impacts of a variation in the temperature of conditioned air from the air conditioner 22 (draft temperature) on the overall operating cost and two other parameters, and FIG. 9, the impacts of a variation in the flow rate of the air blown from the air conditioner 22 on the overall operating cost and two other parameters. FIG. 10 shows the impacts of a variation in the temperature of low/high-temperature heat transfer medium from the low/high-temperature heat generator 18 on the overall operating cost and all (five) other parameters.

In each graph, inevitably, all other parameters than what is manipulated more or less are varied subordinately to meet the requirements of air conditioning that are set. As a result, the overall operating cost, which reflects the total of all the parameters, varies accordingly. To take up FIG. 4 as an example, as the flow rate of the heat discharging/absorbing medium is raised, the load on the heat discharging/absorbing medium pump gradually increases and that on the low/high-temperature heat generator gradually decreases. The load on the heat source/sink scarcely varies. The overall operating cost, which reflects the total of all the parameters, has its minimum at about the 50% flow rate of the heat discharging/absorbing medium.

In FIG. 10, the temperature of low/high-temperature heat transfer medium is plotted on the horizontal axis to demonstrate that there is a point where the overall operating cost is minimized. The horizontal axis can also represent the temperature of the heat discharging/absorbing medium, the flow rate of the heat discharging/absorbing medium, the draft temperature or the draft flow rate for the purpose of graphical expression. Thus, there is the minimum overall operating cost into which all these six parameters are taken into account.

Figure 11:
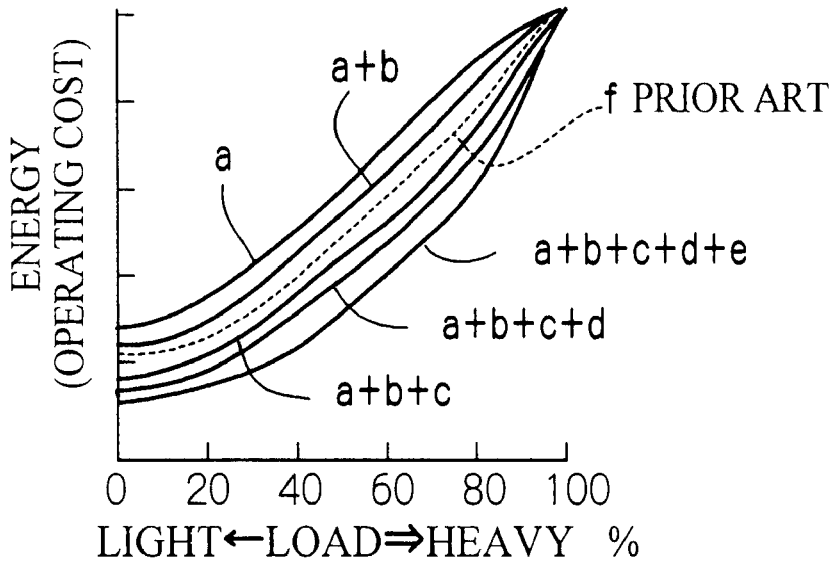

In FIG. 11, the load is plotted on the horizontal axis to enable all these six parameters to be discussed at the same time. Adding the temperature control of the low/high-temperature heat generator 18 to FIG. 5 gives an overall operating cost of a+b+c. Further adding the flow rate control of the heat discharging/absorbing medium pump gives an overall operating cost of a+b+c+d. Adding still further the draft control of the air conditioner gives an overall operating cost of a+b+c+d+e. Incidentally, in the conventional way of control, as each constituent unit is individually controlled, the overall operating cost increases as indicated by a dotted line in FIG. 11 and higher than under the control according to the present invention.

Therefore, the combination of all these factors gives the overall minimum for the whole system, and optimal operation is made possible by using the corresponding conditions as setpoints.

The relationships shown in the graphs of FIGS. 3 through 11 have resulted from the plotting of actual measurements obtained by using the air conditioning plant 10 of FIG. 1, and it is also possible to program a set of software which would give the same relationships and stored it on a computer-readable recording medium for use in such control. This arrangement may prove more convenient because, if there are changes in the piping conditions of the constituent units of the air conditioning plant 10, the number of the air conditioners 22 and/or the specifications of the constituent units, the changed conditions can be simulated before undertaking the actual work.

As can be seen by comparing the graphs of FIGS. 3 through 11, varying any single parameter would result in variations in other parameters and the overall operating cost. Therefore, even if a parameter which gives the minimum overall operating cost in one graph is applied to a relationship in another graph, the optimum cannot be obtained in that other graph. The air conditioning plant control method according to the present invention, the mutual relationships described above being presupposed, will prove to be a control method that simply and quickly makes possible efficient operation of the air conditioning plant as will be described below.

Figure 2:
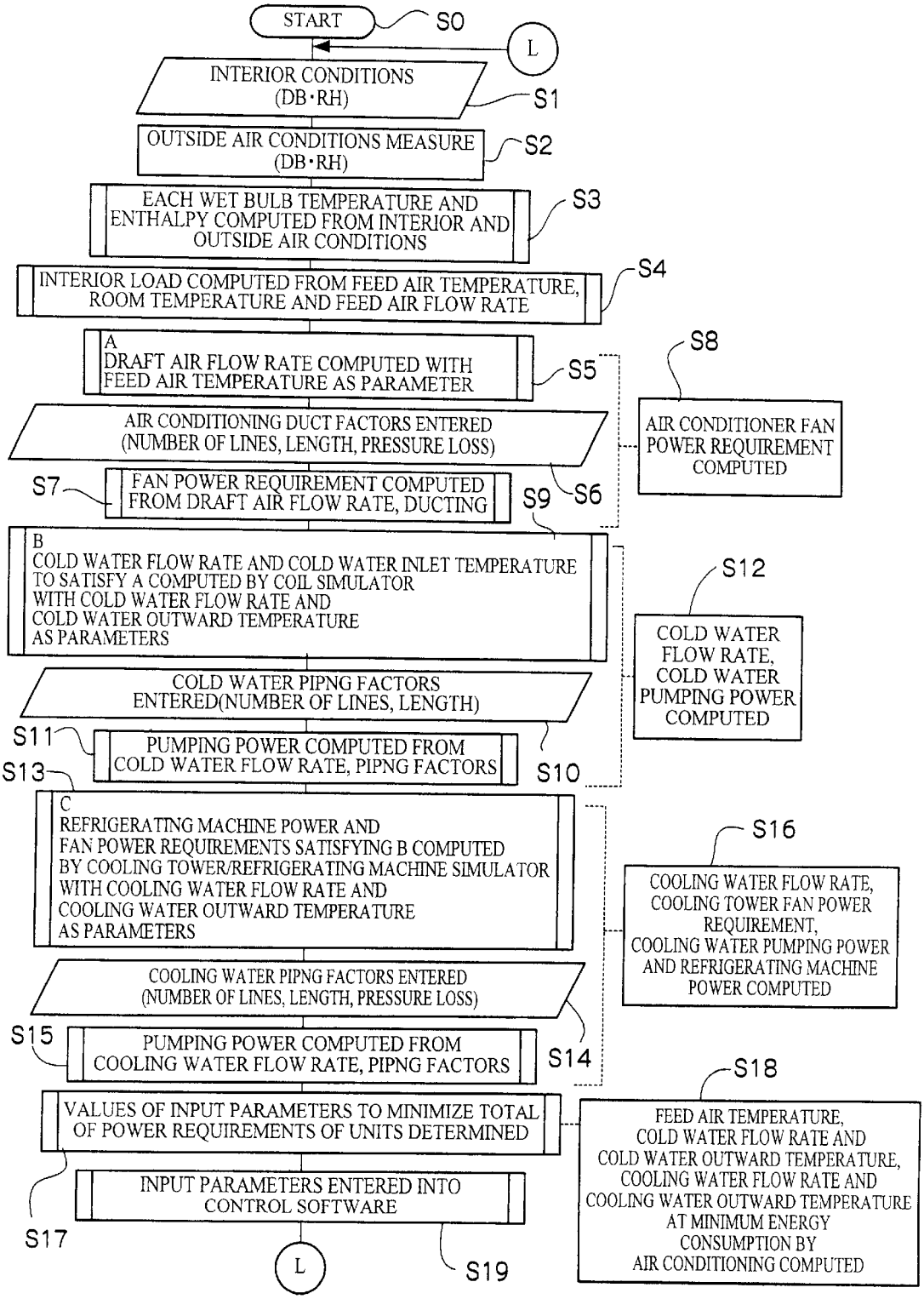
FIG. 2 is a flow chart showing a control method for the air conditioning plant pertaining to the present invention.

FIG. 2 is a flow chart showing the control method for the air conditioning plant 10 shown in FIG. 1. The interior conditions of the building 26 are measured with the dry bulb and wet bulb of a temperature or the like (step S1). The conditions of outside air are also measured with the dry bulb and wet bulb of a temperature or the like (step S2). From these measurements are computed the relative humidity and the enthalpy of each (step S3). Then, the interior load is computed from the draft temperature, room temperature and draft flow rate in the building 26 (step S4).

Next, as a parameter to cause the draft temperature of the air conditioner to vary, the draft flow rate of the air conditioner is computed (step S5) (A). Then, inputting of the piping conditions of the air conditioner (air conditioning ductwork) is requested (step S6) and, coupled with this input value, the power of the fan 24 is computed (steps S7 and S8).

Next, as parameters to vary the flow rate and the outward temperature of the low/high-temperature heat transfer medium from the low/high-temperature heat generator 18, the low/high-temperature heat transfer medium flow rate of the low/high-temperature heat generator and the low/high-temperature heat transfer medium temperature of the low/high-temperature heat generator (inlet temperature) are computed by a coil simulator to satisfy A mentioned above (step S9) (B). Then, inputting of the piping conditions of the low/high-temperature heat generator (low/high-temperature heat transfer medium pipework) is requested (step S10) and, coupled with this input value, the low/high-temperature heat transfer medium flow rate and the pumping power of the low/high-temperature heat transfer medium pump 20 are computed (steps S11 and S12).

Next, as parameters to cause the flow rate and the outward temperature of the heat discharging/absorbing medium from the heat source/sink 14 to vary, the power of the low/high-temperature heat generator 18 and the power of the fan 24 are computed by a heat source/sink/low/high-temperature heat generator simulator to satisfy B mentioned above (step S13) (C). Then, inputting of the piping conditions of the heat source/sink 14 (heat discharging/absorbing medium pipework) is requested (step S14) and, coupled with this input value, the heat discharging/absorbing medium flow rate from the heat source/sink 14, the fan power of the heat source/sink 14, the pumping power of the heat discharging/absorbing medium pump 16 and the power of the low/high-temperature heat generator 18 are computed (steps S15 and S16).

The results of these steps are put together to determine such values of the parameters as minimize the total power consumed by the devices of individual elements (step S17). Thus, the draft temperature of the air conditioner 22, the flow rate and the outward temperature of the low/high-temperature heat transfer medium in the low/high-temperature heat generator 18, and the flow rate and the outward temperature of the heat discharging/absorbing medium from the heat source/sink 14 at which the energy consumption of air condition is minimized are computed (step S18). Then, these input parameters are entered into the control device as control setpoints (step S19).

The air conditioning plant is operated so as to minimize its overall power consumption figured by the flow described above. Since the state varies as the operation is continued, the process returns upstream to step S1 to find out the next optimized setpoints (see L in FIG. 2). The operation is optimized all the time in this loop.

The foregoing description concerted a flow of control method configured to minimize the energy consumption by the air conditioning plant 10, and a similar configuration can also be used to design a flow which would minimize the operating cost of the air conditioning plant 10 or to minimize the carbon dioxide emission of the air conditioning plant 10.

While three parameters including the draft temperature of the air conditioner 22, the low/high-temperature heat transfer medium temperature of the low/high-temperature heat generator 18 (outlet temperature) and the heat discharging/absorbing medium temperature from the heat source/sink 14 (the low/high-temperature heat transfer medium inlet temperature of the low/high-temperature heat generator 18) are varied in the configuration described above with reference to FIG. 1 and FIG. 2, it is also possible to use a configuration in which the setpoints of the low/high-temperature heat transfer medium flow rate of the low/high-temperature heat generator 18 and the heat discharging/absorbing medium flow rate from the heat source/sink 14 are further optimized, or a configuration in which the draft flow rate of the air conditioner 22 is also optimized. In these cases, there are two or three more parameters to be varied. Accordingly, as a price for the increased accuracy of computation, more memories in the control device and faster processing speed may be required.

The frequency of control in the flow whose sequence is shown in FIG. 2 can be set appropriately (e.g., every 20 minutes) according to the volume of the building 26, its environment and the specifications (rating) of the air conditioning plant 10. It is also possible to vary the frequency of control from one season to another. Further, the frequency of control may be varied from one to another of the three parameters to be varied. For instance, the parameter having the greatest impact on power consumption by the air conditioning plant 10 may be controlled every 10 minutes, that having the least impact on power consumption by the air conditioning plant 10, every 60 minutes, and the remaining one parameter, every 30 minutes. This differentiated way of control could prevent hunting or other faults due to excessive control.

Individual control of each of the blocks (the heat source/sink 14 through the building 26) of the air conditioning plant 10 shown in FIG. 1 can be accomplished with individual (local) control devices provided on a commercially available product of that block (e.g., the air conditioner 22) plus overall balancing with a general control device (not shown) connected to the blocks of the air conditioning plant 10. Alternatively, individual (local) control of the blocks of the air conditioning plant 10 can also be accomplished with the general control device (not shown) connected to the blocks the air conditioning plant 10.

Figure 12:
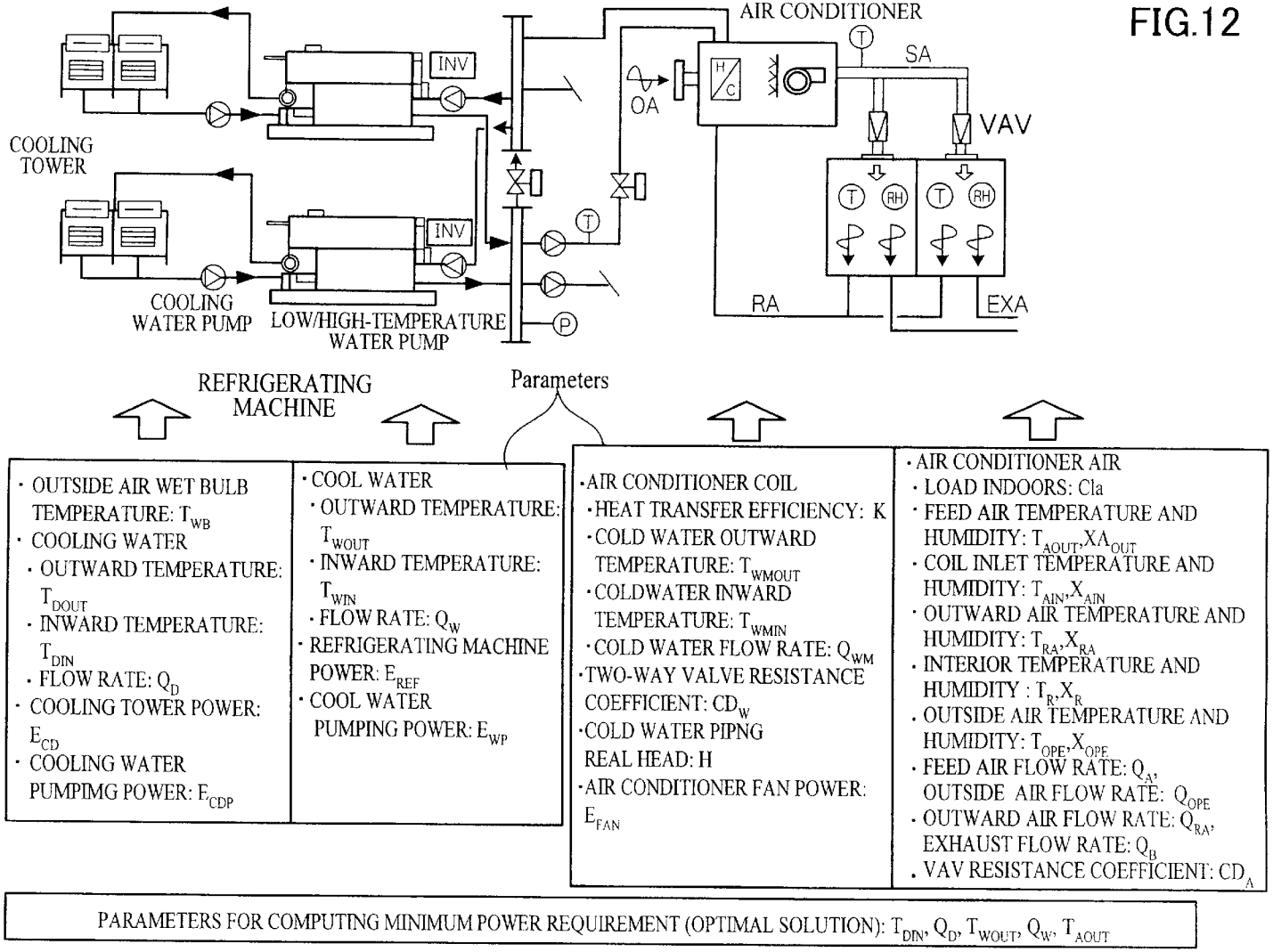
FIG. 12 is a block diagram illustrating another configuration of an air conditioning plant to which the present invention is applied.

FIG. 12 is a block diagram illustrating another configuration of an air conditioning plant to which the present invention is applied, wherein a plurality (L) of low/high-temperature heat generator and a plurality (m) of air conditioners are used. In this diagram, illustration of the heat source/sink is dispensed with, and detectable or controllable parameters are listed. Some of these parameters can be used in addition to the aforementioned parameters for computing the minimum energy consumption (in the bottom box).

However, the additional use of some of the parameters may entail a need for more memories in the control device and faster processing speed as a price for the increased accuracy of computation.

Whereas an air conditioning plant and a control method therefor according to the present invention have been described so far, the present invention is not limited to the above-described mode of implementation, but can be implemented in various other modes.

For instance, the choice of the low/high-temperature heat generator 18 of the air conditioning plant 10 is not limited to various low/high-temperature heat generator (e.g., a turbo low/high-temperature heat generator, an absorption low/high-temperature heat generator and so forth) but includes various cooling devices such as an air-cooled chiller and a water-cooled chiller.

Figure 13:
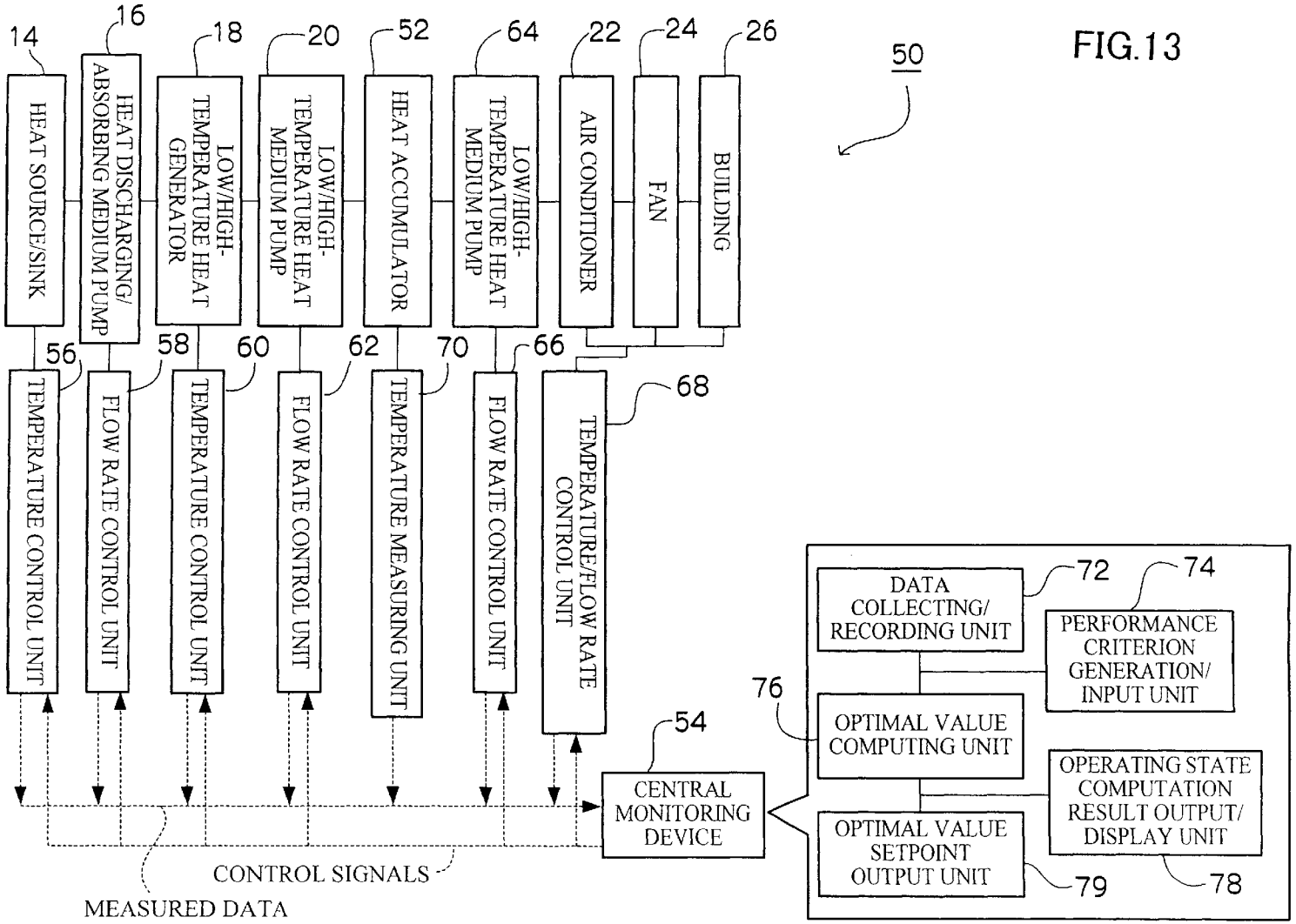
FIG. 13 is a block diagram illustrating an air conditioning plant according to the second embodiment of the present invention.

FIG. 13 is a block diagram illustrating the configuration of an air conditioning plant 50 according to a second embodiment of the present invention, in which members the same as or similar to members of the air conditioning plant 10 shown in FIG. 1 are designated by respectively the same reference signs, and their description is dispensed with. The configuration of the air conditioning plant 50 differs from the air conditioning plant 10 in that it is provided with a heat regenerative layer 52 for storing low/high-temperature heat in the periods of light low/high-temperature heat load. A central monitoring unit 54 which exercises supervisory control over the air conditioning plant 50 optimally controls the temperatures of heat generated by the constituent elements of the air conditioning plant 50 and the flow rate of heat medium conveyance.

Thus, the central monitoring unit 54 controls the temperature control unit 56 of the heat source/sink 14; the flow rate control unit 58 of the heat discharging/absorbing medium pump 16; the temperature control unit 60 of the low/high-temperature heat generator 18; the flow rate control unit 62 of the low/high-temperature heat transfer medium pump 20, the flow rate control unit 66 of the low/high-temperature heat transfer medium pump 64 for supplying low/high-temperature heat transfer medium to the heat regenerative layer 52; and the temperature flow rate control unit 68 for the air conditioner 22 and the fan 24, this according to the temperature and humidity of the building 26, on the basis of data supplied from the respective control units and from the temperature measuring instrument 70 of the heat regenerative layer 52, and thereby optimizes the setpoints of the draft temperature of an air conditioner 22, the low/high-temperature heat transfer medium temperature of the low/high-temperature heat generator 18 and the heat discharging/absorbing medium temperature of the heat source/sink 14 so as to reduce at least one of the power consumption, the operating cost or the carbon dioxide emission of the air conditioning plant 50.

The central monitoring unit 54 further has an optimal value computing unit 76 which computes optimal setpoints on the basis of data entered from a data collecting/recording unit 72 and a performance criterion generation/input unit 74. The central monitoring unit 54 has a function to send optimal values computed by the optimal value computing unit 76 from the optimal value setpoint output unit 79 to the individual control units. The operating state based on the results of these computations is displayed on an operating state computation result output/display unit 78.

Figure 14:
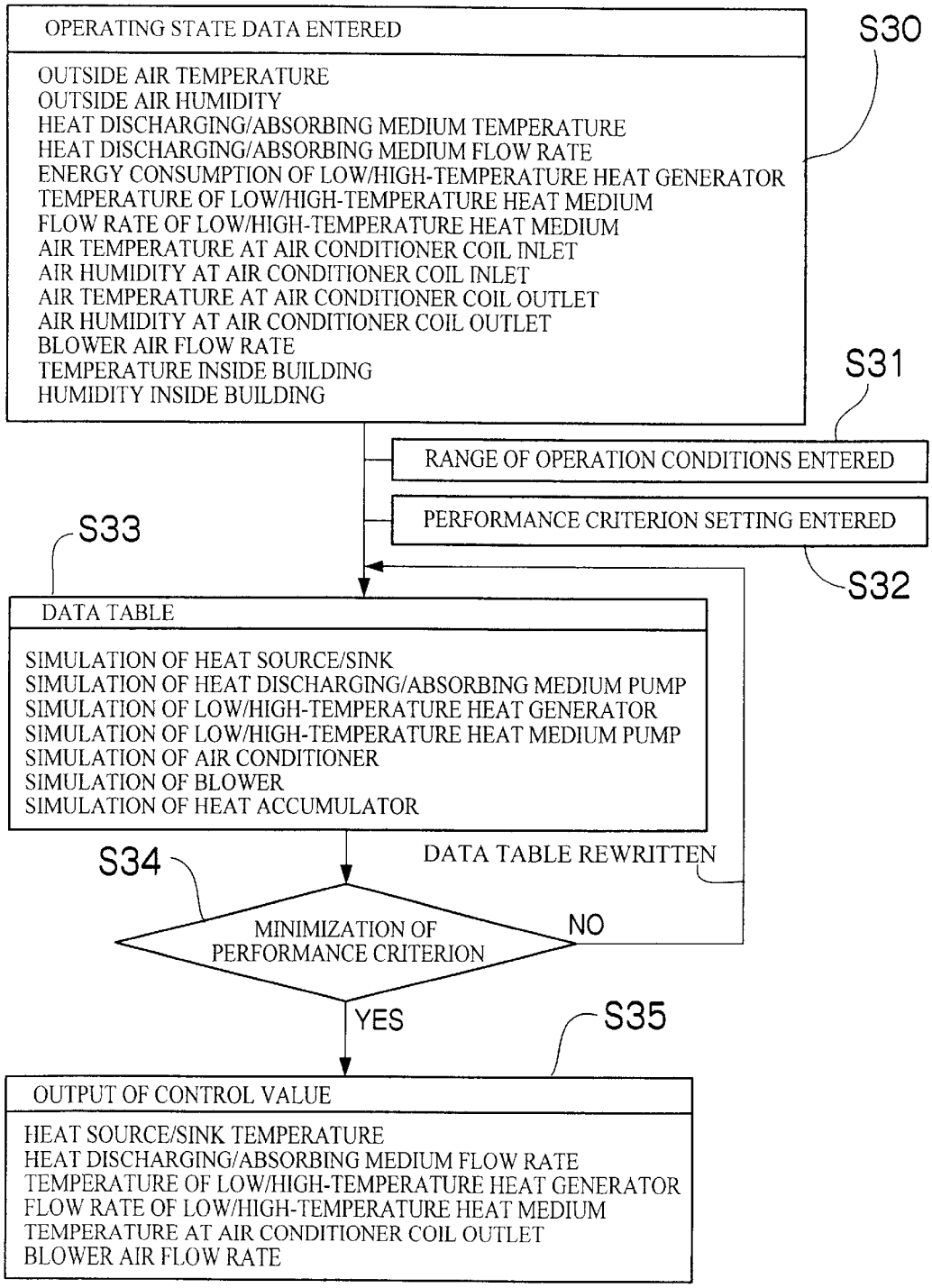
FIG. 14 is a flow chart of the control by a central monitoring device of the air conditioning plant according to the second embodiment of the present invention.

Thus, the central monitoring unit 54 controls the whole air conditioning plant 50 as shown in the flow chart of FIG. 14. In addition entering operating state data (step S30), the range of operating conditions are entered in the central monitoring unit 54 (step S31), and also performance criterion setpoints are entered (step S32). The central monitoring unit 54 conducts computations to minimize performance criteria on the basis of a data table in which these input data and simulation models of constituent units are stored (step S33), rewrites the data table until the performance criteria are minimized and, when the performance criteria are minimized (step S34), supplies control values for constituent units to the individual control units (step S35).

To describe the process in more detail, the central monitoring unit 54, having an air conditioning plant operation simulator for managing the operation of the whole air conditioning plant 50 and/or an air conditioning plant operational data table built into it, computes on the basis of real time operational data picked up from various measuring instruments and control units the optimal operating temperature and/or the optimal flow rate for the constituent units of the air conditioning plant 50 and/or the optimal number of operating units of the low/high-temperature heat generator 18 to minimize the energy consumption, energy cost or carbon dioxide emission equivalent or any indicator combining two or more of these factors of the whole air conditioning plant 50 in predetermined ranges of conditions, including the temperature and humidity, of air conditioning, ranges of energy consumption conditions with respect to electric power, fuel, water and so forth, or various permissible areas of condition setting which satisfy ranges of requirements set by combining these two sets of conditions in a prioritized manner. It supplies those optimal values to the group of control units as control setpoints, and the control unit group generates control signals on the basis of these control setpoints, supplies these control signals to the constituent units of the air conditioning plant 50 or to the pertinent control units themselves to control at least two of the constituent units of the air conditioning plant 50 at substantially the same time.

The central monitoring unit 54 also has the performance criterion generation/input unit 74 which enters from outside the priority ranks or the minimization indicators, both referred to above, and on the basis of entries from this performance criterion generation/input unit 74 and the various permissible areas of condition setting performs the minimizing computations, generates optimal control values and controls at least two of the constituent units of the air conditioning plant at substantially the same time.

Further, the central monitoring unit 54 supplies control setpoints for the draft temperature of the air conditioner 22, the low/high-temperature heat transfer medium temperature of the low/high-temperature heat generator 18 and the heat discharging/absorbing medium temperature from the heat source/sink 14 to the control units 56, 60 and 68, and on that basis controls at least two of the constituent units of the air conditioning plant 10 at substantially the same time.

Also, the central monitoring unit 54 supplies control setpoints for the draft temperature of the air conditioner 22, the low/high-temperature heat transfer medium temperature and the low/high-temperature heat transfer medium flow rate of the low/high-temperature heat generator 18, the heat discharging/absorbing medium temperature from the heat source/sink 14 and the heat discharging/absorbing medium flow rate to the control units 56, 60 and 68, and on that basis controls at least two of the constituent units of the air conditioning plant 50 at substantially the same time.

On the other hand, a boiler can be cited as an example of the low/high-temperature heat generator 18. In this case, too, the central monitoring unit 54 supplies control setpoints of the draft temperature of the air conditioner 22, the hot water temperature and/or the hot water flow rate of the boiler to the control units 60 and 68, and on that basis controls at least two of the constituent units of the air conditioning plant 50 at substantially the same time.

Where the low/high-temperature heat generator 18 is an air-cooled low/high-temperature heat generator/heat pump and the heat source/sink 14 comprises an air-cooled heat exchanger and a fan built into the air-cooled low/high-temperature heat generator/heat pump, the central monitoring unit 54 supplies control setpoints for the draft temperature of the air conditioner 22, and the low/high-temperature heat transfer medium temperature of the low/high-temperature heat generator and/or the air flow rate of the fan to the group of control units, and on that basis controls at least two of the constituent units of the air conditioning plant 50 at substantially the same time.

Or where the low/high-temperature heat generator is an air-cooled low/high-temperature heat generator/heat pump and the heat source/sink comprises an air-cooled heat exchanger and a fan built into the air-cooled low/high-temperature heat generator/heat pump, the central monitoring unit 54 supplies control setpoints for the draft temperature of the air conditioner 22, and the low/high-temperature heat transfer medium temperature and the low/high-temperature heat transfer medium flow rate of the low/high-temperature heat generator and/or the air flow rate of the fan to the group of control units, and on that basis controls at least two of the constituent units of the air conditioning plant 50 at substantially the same time.

The air conditioning plant operational data table shown in FIG. 14 lists the energy consumption, the operating cost, or the carbon dioxide emission equivalent of the whole air conditioning plant 50 in the whole operating ranges of the control parameters given to the group of constituent units which are controlled at substantially the same time.

The air conditioning plant operational data table comprises a plurality of sub-tables in which are entered the ranges of control values that can be the optimal control values in the predetermined various permissible areas of condition setting in the combination of outside air temperature and humidity and air conditioning load. One of these sub-tables is searched with real time operational data picked up from the individual measuring instruments and control units, and the optimal control values are computed with the air conditioning plant operation simulator within the range of control values entered in the sub-table.

Also, the central monitoring unit 54, having an air conditioning plant operation simulator for managing the whole air conditioning plant 50 and/or an air conditioning plant operational data table built into it, computes on the basis of real time operational data picked up from various measuring instruments and control units, the predetermined optimal operating temperature and/or the optimal flow rate for the constituent units of the air conditioning plant 50 and/or the optimal number of operating units of the low/high-temperature heat generator 18 to minimize the energy consumption, energy cost or carbon dioxide emission equivalent or any indicator combining two or more of these factors of the whole air conditioning plant 50 in predetermined ranges of conditions, including the temperature and humidity, of air conditioning, ranges of energy consumption conditions with respect to electric power, fuel, water and so forth, or various permissible areas of condition setting which satisfy ranges of requirements set by combining these two sets of conditions in a prioritized manner and supplies those optimal values to the group of control units as control setpoints, and the control unit group generates control signals on the basis of these control setpoints, supplies these control signals to the constituent units of the air conditioning plant 50 or to the pertinent control units themselves to control at least two of the constituent units of the air conditioning plant 50 at substantially the same time.

Further, in the air conditioning plant 50 having the heat regenerative layer 52, the central monitoring unit 54, having an air conditioning plant operation simulator for managing the whole air conditioning plant 50 and/or an air conditioning plant operational data table built into it, computes on the basis of real time operational data picked up from various measuring instruments and control units, the predetermined optimal operating temperature and/or optimal flow rate for the constituent units of the air conditioning plant 50 and/or the optimal number of operating units of the low/high-temperature heat generator 18 to minimize the energy consumption, energy cost or carbon dioxide emission equivalent or any indicator combining two or more of these factors of the whole air conditioning plant 50 in predetermined ranges of conditions, including the temperature and humidity, of air conditioning, ranges of energy consumption conditions with respect to electric power, fuel, water and so forth, or various permissible areas of condition setting which satisfy ranges of requirements set by combining these two sets of conditions in a prioritized manner and supplies those optimal values to the group of control units as control setpoints, and the control unit group generates control signals on the basis of these control setpoints, supplies these control signals to the constituent units of the air conditioning plant 50 or to the pertinent control units themselves to control at least two of the constituent units of the air conditioning plant 50 at substantially the same time.

The central monitoring unit 54 also has the performance criterion generation/input unit 74 which enters from outside the priority ranks or the minimization indicators, both referred to above.

The central monitoring unit 54 further has the operating state computation result output/display unit 78 which supplies outside and/or displays the energy consumption and/or the operating cost and/or the instantaneous value and/or the integrated value of the carbon dioxide emission equivalent of the whole air conditioning plant 50.

Controlling of the constituent units of the air conditioning plant 50 by the central monitoring unit 54 as described above makes it possible to reduce the energy consumption, the operating cost or the carbon dioxide emission of the whole air conditioning plant 50.

Figure 15:
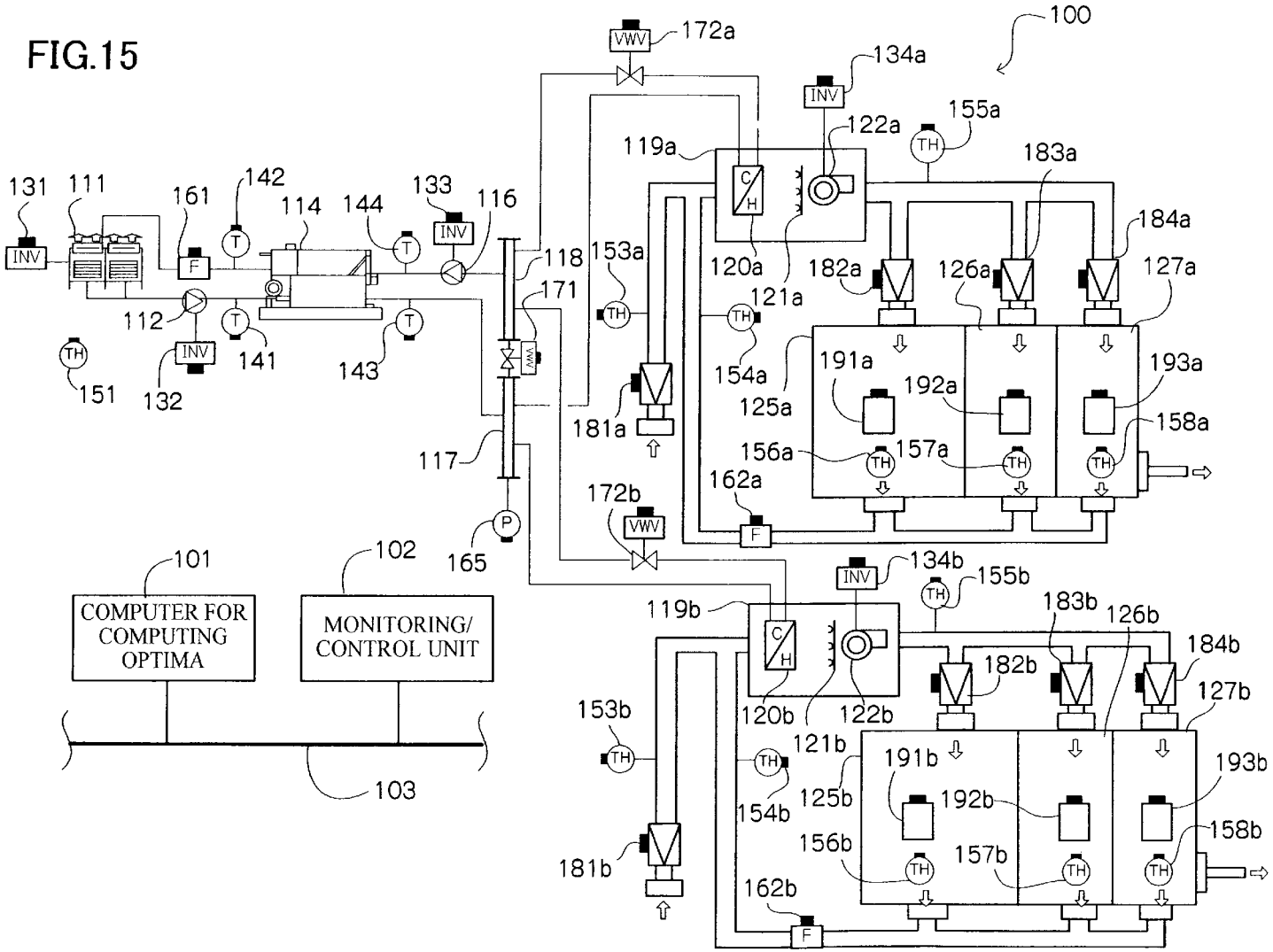
FIG. 15 is a configurational diagram of an air conditioning plant according to the third embodiment of the present invention.

FIG. 15 is a configurational diagram of an air conditioning plant according to a third embodiment of the present invention. An air conditioning plant 100 shown in FIG. 15 is a central air conditioning plant provided with a heat source/sink 111, a heat discharging/absorbing medium pump 112, an absorption type low/high-temperature heat generator 114, a low/high-temperature heat transfer medium pump 116, a low/high-temperature heat transfer medium outward header 117, a low/high-temperature heat transfer medium inward header 118, and the air conditioners 119*a* and 119*b*.

First will be described the detailed configuration of equipment on the low/high-temperature heat transfer medium producing side.

To vary the air flow rate of the heat source/sink 111, an inverter 131 is connected to the fan of the heat source/sink 111. To vary the flow rate of the heat discharging/absorbing medium, an inverter 132 is connected to the heat discharging/absorbing medium pump 112. To vary the flow rate of the low/high-temperature heat transfer medium, an inverter 133 is connected to the low/high-temperature heat transfer medium pump 116. The absorption type low/high-temperature heat generator 114 is an absorption type low/high-temperature heat generator cable of varying the control target of the low/high-temperature heat transfer medium outlet temperature at an instruction from outside. The absorption type low/high-temperature heat generator 114 further is an absorption type low/high-temperature heat generator capable of reducing the flow rate to ½ of the rated flow rate of both the heat discharging/absorbing medium and the low/high-temperature heat transfer medium.

To the heat discharging/absorbing medium piping are connected a flow rate sensor 161 for measuring the heat discharging/absorbing medium flow rate, a temperature sensor 141 for measuring the heat discharging/absorbing medium inlet temperature of the absorption type low/high-temperature heat generator 114 and a temperature sensor 142 for measuring the heat discharging/absorbing medium outlet temperature of the absorption type low/high-temperature heat generator 114. To the primary low/high-temperature heat transfer medium piping are connected a temperature sensor 143 for measuring the low/high-temperature heat transfer medium inlet temperature of the absorption type low/high-temperature heat generator 114 and a temperature sensor 144 for measuring the low/high-temperature heat transfer medium outlet temperature of the absorption type low/high-temperature heat generator 114. In the vicinity of the heat source/sink 111 outdoors is installed a temperature/humidity sensor 151 for measuring the temperature and humidity of the outside air flowing into the heat source/sink 111.

Next will be described the detailed configuration of equipment on the part of loads.

An air conditioner 119*a* is provided with a low/high-temperature heat transfer medium coil 120*a*, a humidifier 121*a* and a fan 122*a*. To vary the flow rate of air passing the air conditioner 119*a*, an inverter 124*a* is connected to the fan 122*a*.

In the outside air intake duct of the air conditioner 119*a* is installed a variable air volume (VAV) unit 181*a* so that outside air can be taken in at a set flow rate, and a temperature/humidity sensor 153*a* is connected to it for measuring the temperature and humidity of the outside air that has been taken in. The VAV unit 181*a* is provided with a flow rate sensor for measuring the flow rate of the air passing the VAV unit 181*a*, a damper for varying the air flow rate, a damper opening sensor for measuring the opening of the damper and a control device, and PID control is effected to bring the flow rate of the air passing the VAV unit 181*a* to a target instructed from outside. Other VAV units 182*a*, 183*a*, 181*b*, 182*b* and 183*b* are similarly configured.

To an indoor air intake duct for taking in the air within the room 125*a* are connected a flow rate sensor 162*a* for measuring the flow rate of the air taken into the indoor air intake duct and a temperature/humidity sensor 154*a* for measuring its temperature and humidity. To a discharge duct is connected a temperature/humidity sensor 155*a* for measuring the temperature and humidity of the air blown out of the air conditioner 119*a*. Each air outlet of the discharge duct is provided with VAV units 182*a* and 183*a* so that the flow rate of the air blown out of each air outlet can be controlled.

The flow rate of the air from each air outlet is subjected to VAV control by the VAV units 182*a* and 183*a* and an inverter 134*a* of the fan 122*a*.

Next will be described a method of the VAV control.

In the room 125*a* are installed a temperature/humidity sensor 156*a* for measuring the temperature and humidity of the air within the room and a temperature target setting unit 191*a* for setting the target of the temperature within the room 125*a*. For the temperature in the room 125*a*, the VAV unit 182*a* computes under PID control the target flow rate of the discharge air into the room 125*a* on the basis of the temperature target for the interior of the room 125*a* set by the temperature target setting unit 191*a*, the temperature of the air inside the room 125*a* measured by the temperature/humidity sensor 156*a* and the air temperature within the discharge duct measured by the temperature/humidity sensor 155*a*, and a damper within the VAV unit 181*a* is subjected to PID control to bring the flow rate of the discharge air to that target. Rooms 126*a* and 127*a* are configured similarly to the room 125*a*, and their interior temperatures are controlled in the like manner.

The frequency of the inverter 134*a* of the fan 122*a* is subjected to PID control so as to bring the flow rate of the discharge air from the VAV unit, installed at the air outlet on the discharge duct route where the pressure loss is the greatest at the target flow rate of the discharge air, to the target flow rate of the discharge air when the damper of that VAV unit is fully opened.

Figure 18:
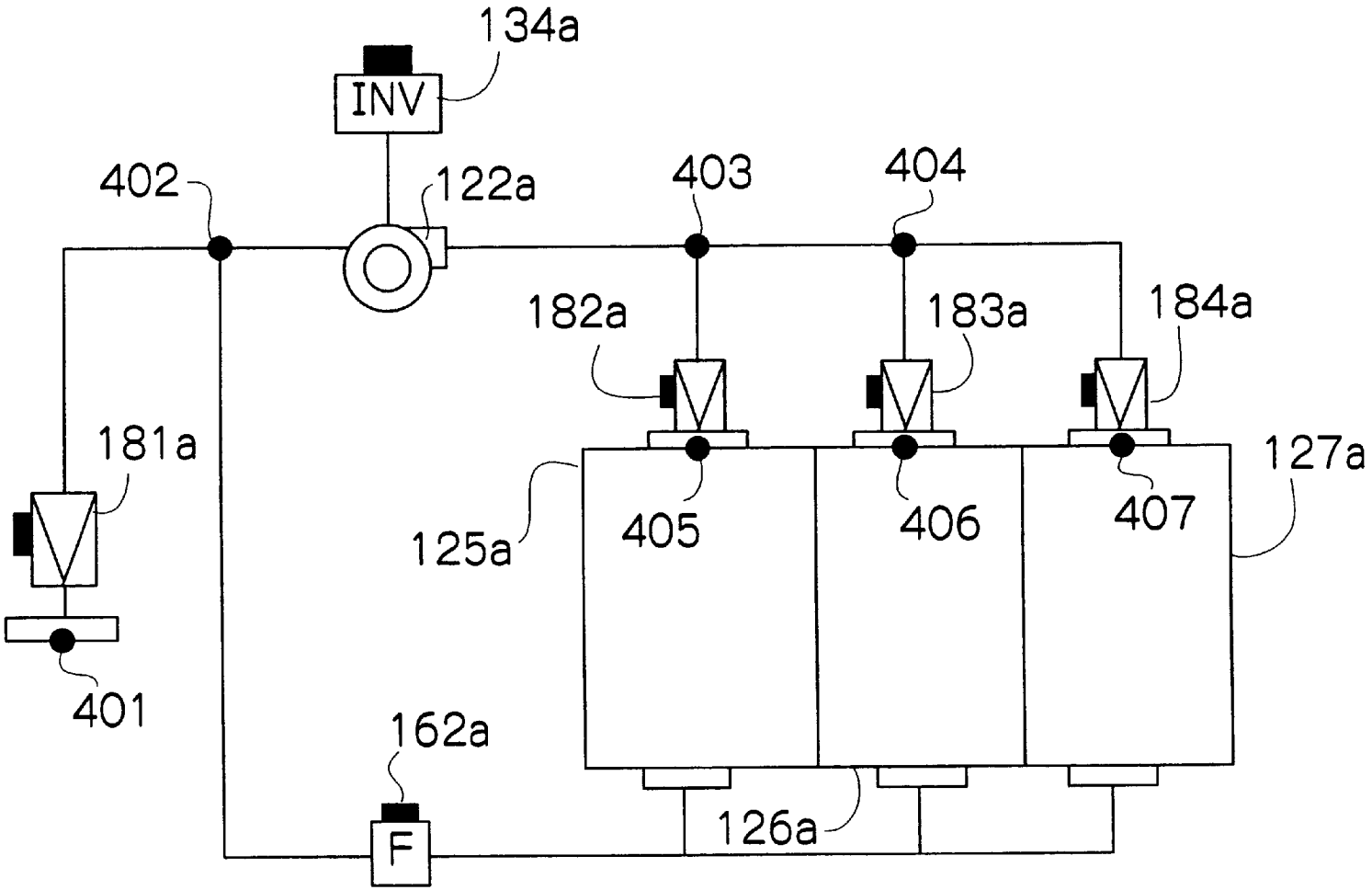
FIG. 18 illustrates ducting arrangement in the third embodiment of the present invention.

Next will be described how the discharge duct route where the pressure loss is the greatest at the target flow rate of the discharge air can be identified. FIG. 18 illustrates the ducting arrangement. The following equations 1, 2 and 3 represent the pressure loss on each discharge duct route when the flow rate of the discharge air is at its target and the damper of the VAV unit is fully opened:

$$\Delta P_1 = R_{\alpha 4} Q_{r\alpha 1}^2 \tag{1}$$

$R_{\alpha 4}$: Duct resistance coefficient from point 403 to point 405 when the damper of the VAV unit 182*a* is fully open $Q_{r\alpha 1}$: Flow rate target of the discharge air for the VAV unit 182*a*

$$\Delta P_2 = R_{\alpha 3}(Q_{r\alpha 2} + Q_{r\alpha 3})^2 + R_{\alpha 5} Q_{r\alpha 2}^2 \tag{2}$$

$R_{\alpha 3}$: Duct resistance coefficient from point 403 to point 404

$R_{\alpha 5}$: Duct resistance coefficient from point 404 to point 406 when the damper of the VAV unit 183*a* is fully open $Q_{r\alpha 2}$: Flow rate target of the discharge air for the VAV unit 183*a*

$Q_{r\alpha 3}$: Flow rate target of the discharge air for the VAV unit 184*a*

$$\Delta P_3 = R_{\alpha 3}(Q_{r\alpha 2} + Q_{r\alpha 3})^2 + R_{\alpha 6} Q_{r\alpha 3}^2 \tag{3}$$

$R_{\alpha 5}$: Duct resistance coefficient from point 404 to point 407 when the damper of the VAV unit 183*a* is fully open The discharge duct route where the pressure loss is the greatest at the target flow rate of the discharge air is the route where the pressure loss figured out by the equations 1, 2 and 3 is the greatest, and the damper of the VAV unit corresponding to it is fully opened. Incidentally, the equations 1, 2 and 3 require the resistance coefficient of the duct, and the method of identifying the resistance coefficient of the duct will be described afterwards. The same applies to the VAV control of the air conditioner 119*b* line.

The low/high-temperature heat transfer medium flow rate is subjected to variable water volume (VWV) control by VWV units 171, 172*a* and 172*b* and the inverter 133 of the low/high-temperature heat transfer medium pump 116.

Next will be described the method of VWV control.

The discharge temperature of the air conditioner 119*a* is controlled with the flow rate of the low/high-temperature heat transfer medium flowing into the low/high-temperature heat transfer medium coil 120*a* controlled by the VWV unit 172*a*. The VWV unit 172*a* is provided with a flow rate sensor which measures the flow rate of the low/high-temperature heat transfer medium flowing in the VWV unit, a flow rate control valve which controls the flow rate of the low/high-temperature heat transfer medium flowing in the VWV unit, an opening sensor which measures the opening of the flow rate control valve, and a control device. The other VWV units 171 are 172*b* similarly configured. The VWV unit 171 computes the target value of the low/high-temperature heat transfer medium flow rate on the basis of the target of the discharge temperature given from outside and the actual discharge temperature measured by the temperature/humidity sensor 155*a*, and subjects the flow rate control valve within the VWV unit 172*a* to PID control on the basis of the target value of the low/high-temperature heat transfer medium flow rate and the measurement by the flow rate sensor within the VWV unit 172*a*. The air conditioner 119*b* line for rooms 125*b*, 126*b* and 127*b* are similarly configured to the air conditioner 119*a* line for the rooms 125*a*, 126*a* and 127*a*, and is controlled by a similar method.

The VWV unit 171 is intended to effect control so as to prevent the flow rate of the low/high-temperature heat transfer medium flowing through the absorption type low/high-temperature heat generator 114 from dropping below ½ of its rated flow rate. If the total of the flow rates of the low/high-temperature heat transfer medium measured by the VWV unit 172*a* and the VWV unit 172*b* is not less than ½ of the rated low/high-temperature heat transfer medium flow rate of the absorption type low/high-temperature heat generator 114, the flow rate control valve of the VWV unit 171 will be totally closed. If the total of the flow rates of the low/high-temperature heat transfer medium measured by the VWV unit 172*a* and the VWV unit 172*b* is smaller than ½ of the rated low/high-temperature heat transfer medium flow rate of the absorption type low/high-temperature heat generator 114, the flow rate control valve of the VWV unit 171 will be so controlled as to raise the total of the flow rates of the low/high-temperature heat transfer medium measured by the VWV unit 171, the VWV unit 172*a* and the VWV unit 172*b* to ½ of the rated low/high-temperature heat transfer medium flow rate of the absorption type low/high-temperature heat generator 114.

The frequency of the inverter 133 of the low/high-temperature heat transfer medium pump 116 is subjected to PID control so as to bring the flow rate of the low/high-temperature heat transfer medium in the VWV unit, installed at the air outlet on the discharge duct route where the pressure loss is the greatest at the target flow rate of the low/high-temperature heat transfer medium, to the target flow rate of the low/high-temperature heat transfer medium when the flow rate control valve of that VWV unit is fully opened.

Figure 19:
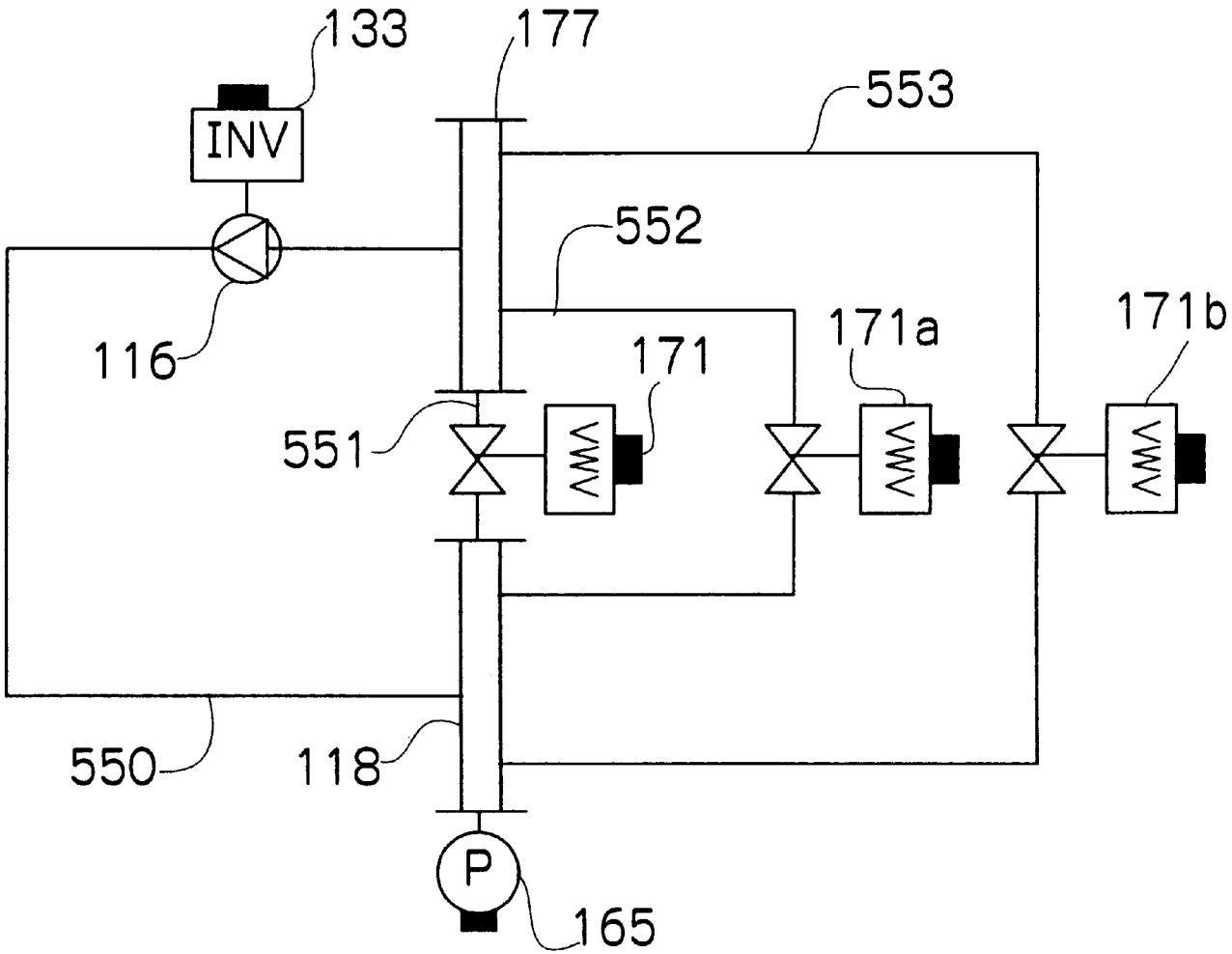
FIG. 19 illustrates piping arrangement in the third embodiment of the present invention.

Next will be described how the discharge duct route where the pressure loss is the greatest at the target flow rate of the low/high-temperature heat transfer medium can be identified. FIG. 19 illustrates the ducting arrangement. The following equation 4 represents the pressure loss on each discharge duct route when the flow rate of the low/high-temperature heat transfer medium is at its target and the flow rate control valve of the VWV unit is fully opened:

$$H_i = R_i Q_{ri}^2 (1 \leqq i \leqq 3) \quad (4)$$

$H_1$: Loss of head on a channel 551 (from the cold or hot water outward header 118 to the cold or hot water inward header 117)

$H_2$: Loss of head on a channel 552 (from the cold or hot water outward header 118 the cold or hot water inward header 117)

$H_3$: Loss of head on a channel 553 (the cold or hot water outward header 118 the cold or hot water inward header 117)

$Q_{r1}$: Target of the cold or hot water flow rate of the VAV unit 171

$Q_{r2}$: Target of the cold or hot water flow rate of the VAV unit 172*a*

$Q_{r3}$: Target of the cold or hot water flow rate of the VAV unit 172*b*

$R_0$: Resistance coefficient of channel 550 (from the cold or hot water inward header 117 to the cold or hot water outward header 118)

$R_1$: Resistance coefficient on the channel 551 (from the cold or hot water outward header 118 to the cold or hot water inward header 117)

$R_2$: Resistance coefficient on the channel 552 (from the cold or hot water outward header 118 to the cold or hot water inward header 117)

$R_3$: Resistance coefficient on the channel 553 (from the cold or hot water outward header 118 to the cold or hot water inward header 117)

The discharge duct route where the pressure loss is the greatest at the target flow rate of the low/high-temperature heat transfer medium is the route where the pressure loss figured out by the equation 4 is the greatest, and the flow rate control valve of the VWV unit corresponding to it is fully opened. Incidentally, the equation 4 requires the resistance coefficient of the duct in which the low/high-temperature heat transfer medium flows, and the method of identifying the resistance coefficient of the duct in which the low/high-temperature heat transfer medium flows will be described afterwards.

Next will be described the communication network of the air conditioning plant with reference to FIG. 15.

The absorption type low/high-temperature heat generator 114, inverters 131, 132, 133, 134*a* and 134*b*, temperature sensors 141, 142, 143 and 144, temperature/humidity sensors 151, 153*a*, 153*b*, 154*a*, 154*b*, 155*a*, 155*b*, 156*a*, 156*b*, 157*a* and 157*b*, flow rate sensors 61, 62*a* and 62*b*, pressure sensor 65, VWV units 171, 172*a*, 172*b*, VAV units 181*a*, 181*b*, 182*a*, 182*b*, 183*a*, 183*b*, temperature target setting units 91*a* and 91*b*, a computer 101 for computing optima and a monitoring/control unit 102 are provided with communication devices.

The absorption type low/high-temperature heat generator 114, inverters 131, 132, 133, 134*a* and 134*b*, temperature sensors 141, 142, 143 and 144, temperature/humidity sensors 151, 153*a*, 153*b*, 154*a*, 154*b*, 155*a*, 155*b*, 156*a*, 156*b*, 157*a* and 157*b*, flow rate sensors 61, 62*a* and 62*b*, pressure sensor 65, VWV units 171, 172*a* and 172*b*, VAV unit 181*a*, 181*b*, 182*a*, 182*b*, 183*a* and 183*b*, temperature target setting unit 91*a* and 91*b*, computer 101 for computing optima, and a monitoring/control unit 102 are connected to a communication network 103, and can transmit and receive data via the communication network 103.

Next will be described details of the computer 101 for computing optima.

Figure 16:
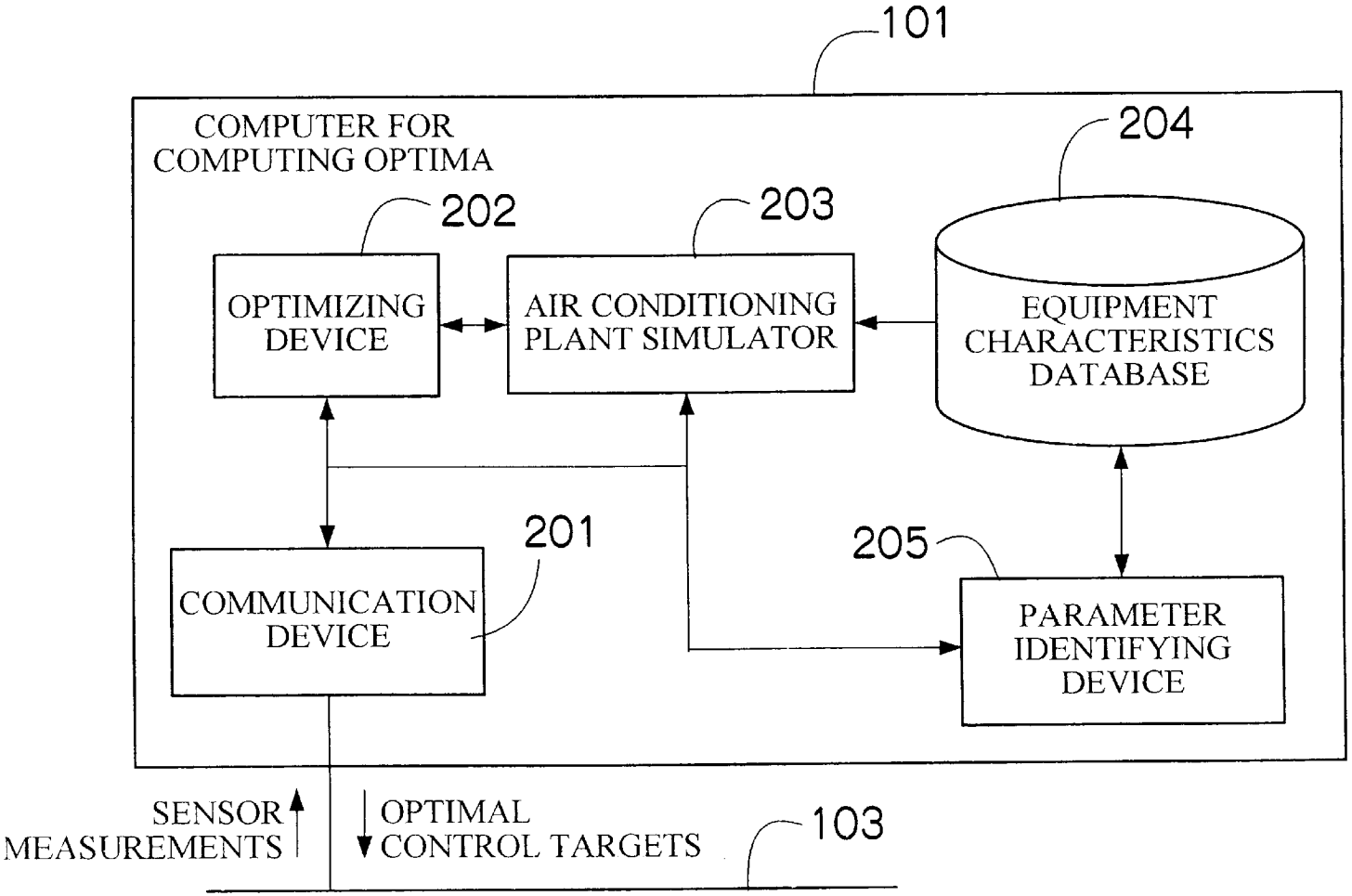
FIG. 16 illustrates the configuration of a computer for computing optima in the third embodiment of the present invention.

FIG. 16 illustrates a configuration of the computer 101 for computing optima. The computer 101 for computing optima is configured of a communication device 201 which engages in communication with units of equipment connected to the communication network 103, an equipment characteristics database 204 which stores characteristics data on air conditioning equipment used for simulating an air conditioning plant and simulation parameters or the like required for simulation including the resistance coefficients of piping and ducting, an air conditioning plant simulator 203 which simulates an air conditioning plant by using data stored in the equipment characteristics database 204, an optimizing device 202 which computes the optimal control targets for the air conditioning plant by using the air conditioning plant simulator 203, and a parameter identifying device 205 which identifies simulation parameters including resistance coefficients of piping and ducting by using data measured by sensors.

The computer 101 for computing optima, receiving via the communication network 103, temperatures and humidities measured by the temperature/humidity sensors 151, 153*a*, 153*b*, 154*a*, 154*b*, 155*a* and 155*b*, flow rates measured by the flow rate sensors 62*a* and 62*b*, and flow rates measured by the VAV units 182*a*, 182*b*, 183*a* and 183*b*, computes the heat discharging/absorbing medium temperature control target, the heat discharging/absorbing medium flow rate control target, the low/high-temperature heat transfer medium temperature control target and the air conditioner discharge temperature control target to minimize the energy consumption, the operating cost or the carbon dioxide emission of the whole air conditioning plant. Hereinafter the combination of the heat discharging/absorbing medium temperature control target, the heat discharging/absorbing medium flow rate control target, the low/high-temperature heat transfer medium temperature control target and the air conditioner discharge temperature control target to minimize the energy consumption, the operating cost or the carbon dioxide emission of the whole air conditioning plant will be referred to as the optimal control target.

The computer 101 for computing optima is provided with the air conditioning plant simulator 203 in which simulation models of the heat source/sink 111, the heat discharging/absorbing medium pump 112, the absorption type low/high-temperature heat generator 114, a low/high-temperature heat transfer medium pump 115, the air conditioners 119*a* and 119*b*, VWV control, VAV control and so forth are stated and the equipment characteristics database 204 in which are stored equipment characteristics data on the heat source/sink 111, the heat discharging/absorbing medium pump 112, the absorption type low/high-temperature heat generator 114, the low/high-temperature heat transfer medium pump 115 and the air conditioners 119*a* and 119*b*, control parameters for VWV control, VAV control and so forth, and simulation parameters required for the simulation, including the resistance coefficients of piping and ducting or the like.

This air conditioning plant simulator 203, when measurements by temperature sensors and humidity sensors and the control target of the heat discharging/absorbing medium temperature, the control target of the heat discharging/absorbing medium flow rate, the control target of the low/high-temperature heat transfer medium temperature, and the control target of the air conditioner discharge temperature are entered into it, computes the overall performance criteria by using data in the equipment characteristics database 204 and simulation models. In the following description, the performance criteria will be represented by the operating cost.

As the simulation models for use by the air conditioning plant simulator 203, simulation models of the heat source/sink 111, heat discharging/absorbing medium pump 112, the absorption type low/high-temperature heat generator 114, low/high-temperature heat transfer medium pump 115, air conditioners 119*a* and 119*b*, VWV control, VAV control and so forth are programmed, modularized for each individual unit of equipment. For instance, there are modularized a program for computing the heat discharging/absorbing medium temperature, power consumption and so forth at the heat discharging/absorbing medium outlet of the heat source/sink 111 in accordance with a theory using enthalpy difference-referenced total volume heat transfer rate of the heat source/sink 111; a program for computing the delivery flow rates and power consumptions of the heat discharging/absorbing medium pump 112 and the low/high-temperature heat transfer medium pump 116 from the performance curves of the heat discharging/absorbing medium pump 112 and the low/high-temperature heat transfer medium pump 116 and the resistance coefficient of the piping; a program for computing the heat discharging/absorbing medium outlet temperature, gas consumption and so forth of the absorption type low/high-temperature heat generator 114 by cycle simulation of the absorption type low/high-temperature heat generator 114; a program for computing the low/high-temperature heat transfer medium flow rates required by the low/high-temperature heat transfer medium coils 120*a* and 120*b* of the air conditioners 119*a* and 119*b*, the low/high-temperature heat transfer medium temperatures at the low/high-temperature heat transfer medium outlets of the low/high-temperature heat transfer medium coils 120*a* and 120*b*, the power consumption of the fan 122*a* and so forth; a program for computing the pressure loss in piping under VWV control; and a program for computing the pressure loss in ducting under VAV control.

According to a program of the air conditioning plant simulator 203, when measurements by temperature sensors, humidity sensors, the control target of the heat discharging/absorbing medium temperature, the control target of the heat discharging/absorbing medium flow rate, the control target of the low/high-temperature heat transfer medium temperature, and the control target of the air conditioner discharge temperature are entered, the gas consumption by the absorption type low/high-temperature heat generator 114, and electric power consumption by the fans 122*a* and 122*b*, inverter 134*a* and 134*b*, low/high-temperature heat transfer medium pump 116, inverter 133, heat discharging/absorbing medium pump 112, inverter 132, fan of the heat source/sink 111 and inverter 131 are computed. The total of gas consumption and that of power consumption are computed, from which the gas and power charges are calculated by using the unit prices of gas and power, and the gas and power charges are totaled to figure out the operating cost, which is the performance criterion in this case.

The optimizing device 202 is intended for computation of the control target of the heat discharging/absorbing medium temperature, the control target of the heat discharging/absorbing medium flow rate, the control target of the low/high-temperature heat transfer medium temperature, and the control target of the air conditioner discharge temperature to minimize the operating cost, which is the performance criterion, by using the air conditioning plant simulator 203. Applicable methods of optimization include one by which all the combinations of control targets which are varied and the combination of control targets which gives the lowest operating cost is selected, the quasi-Newton method, the conjugate gradient method, the steepest descent method and the sequential quadratic method.

Although the operating cost is used as the performance criterion and optimal values to minimize the operating cost were sought, the performance criterion can be replaced with some other factor. For instance, it is also possible to minimize the crude oil equivalent of primary energy consumption, the carbon dioxide emission or the like by altering the coefficient of conversion. Alternatively, the operating cost, the crude oil equivalent of primary energy consumption, the carbon dioxide emission and so forth are weighted appropriately to work out an integrated performance criterion, and the optima to minimize that performance criterion can be figured out.

Next will be described the methods of identifying the piping resistance coefficient, the duct resistance coefficient and other simulation parameters used by the parameter identifying device 205. Although the piping resistance coefficient and the duct resistance coefficient can be computed from the shapes of the piping and ducting, the computed coefficients would be somewhat different from the actual piping resistance coefficient and duct resistance coefficient in most cases. Therefore, simulation parameters including the piping resistance coefficient and the duct resistance coefficient are identified in this case according to measurements by sensors. The methods are as follows.

Figure 20:
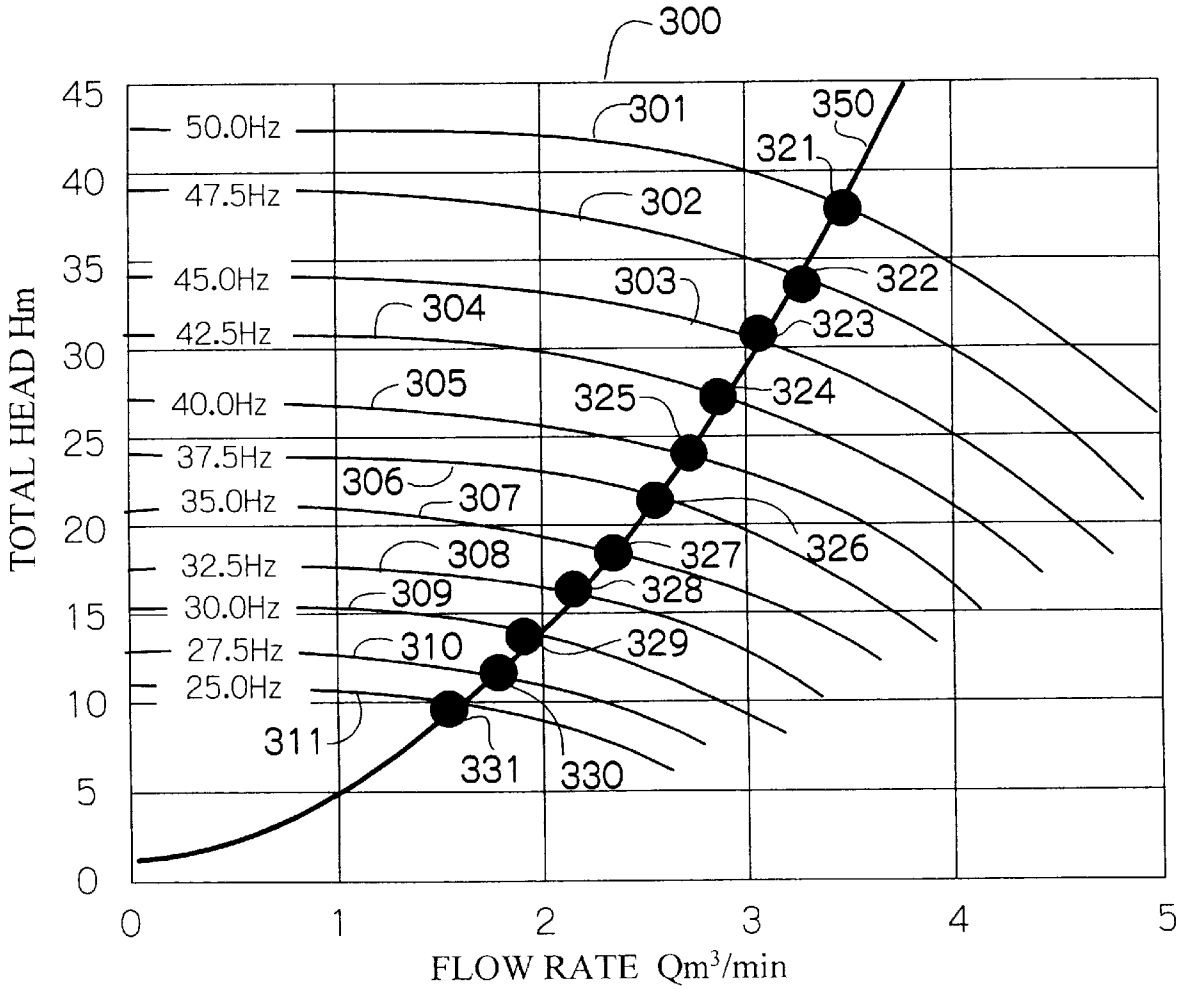
FIG. 20 is a diagram for describing a method for figuring out the piping resistance curve of the heat discharge/intake medium piping.

First will be described the method of identifying the piping resistance coefficient of the low/high-temperature heat transfer medium pump 116. FIG. 20 is a diagram for describing a method for figuring out the piping resistance curve of the heat discharge/intake medium piping. A curve 301 represents the relationship between the delivery flow rate and the total head of the heat discharging/absorbing medium pump 112 as stated in the test certificate (power supply at 50 Hz). Curves 301, 302, 303, 304, 305, 306, 307, 308, 309, 310 and 311 represent the relationships between the delivery flow rate and the total head of the heat discharging/absorbing medium pump when the frequency of the inverter 132 is 47.5 Hz, 45.0 Hz, 42.5 Hz, 40.0 Hz, 37.5 Hz, 35.0 Hz, 32.5 Hz, 30.0 Hz, 27.5 Hz and 25.0 Hz, respectively. The curves 302 through 311 are based on the supposition that the flow rate of the pump is linearly proportional to the power frequency and the total head of the pump is proportional to the square of the power frequency, both based on the curve 301 at a frequency of 50 Hz.

First, with the frequency of the inverter 132 being set to 50 Hz, the heat discharging/absorbing medium pump 112 is operated, and the heat discharging/absorbing medium flow rate is measured with the flow rate sensor 161. Then, the total head at the time is figured out from the curve 301. A plot 321 represents the total head figured out from the measured flow rate of the heat discharging/absorbing medium and the curve 301.

Next, with the frequency of the inverter 132 being reduced to 47.5 Hz, the heat discharging/absorbing medium pump 112 is operated, and the heat discharging/absorbing medium flow rate is measured with the flow rate sensor 161. The total head is figured out in the same way to obtain a plot 322. The similar procedure is taken at 45.0 Hz, 42.5 Hz, 40.0 Hz, 37.5 Hz, 35.0 Hz, 32.5 Hz, 30.0 Hz, 27.5 Hz and 25.0 Hz, and plots 323, 324, 325, 326, 327, 328, 329, 330 and 331 are obtained. With the resistance curve of the heat discharging/absorbing medium channel being assumed to be a quadratic curve, it is figured out by the method of least squares. The curve 350 is the resistance curve of the heat discharging/absorbing medium channel figured out by the method of least squares, with the resistance curve of the heat discharging/absorbing medium channel being assumed to be a quadratic curve. This resistance curve is used for the simulation.

Now will be described the method by which the piping resistance coefficient of the low/high-temperature heat transfer medium pump 116 is identified.

The following equation 5 represents the relationship between the delivery flow rate of the low/high-temperature heat transfer medium pump 116 and the total head:

$$H=h(Q) \tag{5}$$

H: Total head of the cold or hot water pump 116

Q: Delivery flow rate of the cold or hot water pump 116

The equation 5 gives an approximate curve of the low/high-temperature heat transfer medium pump figured out by the method of least squares using the test certificate of the pump. Since the delivery flow rate and the total head of the low/high-temperature heat transfer medium pump 116 are proportional to the frequency of the inverter 133 linearly and quadratically, respectively, when the frequency of the inverter 133 is altered the relationship of the following equation 6 will result:

$$H=(f_{33}/50)^2 h(50Q/f_{33}) \tag{6}$$

$f_{33}$: Frequency of the inverter 133

Regarding the low/high-temperature heat transfer medium channel where the flow rate control valves of VWV units are fully opened, the following equation 7 holds:

$$R_0(Q_1+Q_2+Q_3)^2+R_iQ_i^2+H_0=(f_{33}/50)^2 h(50(Q_1+Q_2+Q_3)/f_{33})(1\leq i\leq 3) \tag{7}$$

$Q_1$: Flow rate of cold or hot water flowing in the VWV unit 171

$Q_2$: Flow rate of cold or hot water flowing in the VWW unit 172*a*

$Q_3$: Flow rate of cold or hot water flowing in the VWV unit 172*b*

$R_0$: Resistance coefficient of the channel 550

$R_1$: Resistance coefficient of the channel 551 when the valve of the VWV unit 171 is fully open $R_2$: Resistance coefficient of the channel 552 when the valve of the VWV unit 172*a* is fully open $R_3$: Resistance coefficient of the channel 553 when the valve of the VWV unit 172*b* is fully open $H_0$: Coefficient of a constant term Now, the equation 7 is rearranged into the following equations 8 and 9:

$$x=[R_0, R_1, R_2, R_3, H_0]^T \tag{8}$$

$$y=z^T x \tag{9}$$

With the combination of VWV units whose flow rate control valves are fully opened and the frequency of the inverter 133 being varied, the flow rates of the low/high-temperature heat transfer medium are measured with the flow meters of the VWV units 171, 172 and 173. Then, on the basis of the measured data, the resistance coefficient of the low/high-temperature heat transfer medium channel is figured out by the method of least squares as represented in the following equations 10, 11, 12 and 13:

$$\hat{x}_1\text{: Random (usually 0 is chosen)} \tag{10}$$

$$P_1=\alpha I \text{ (I is a unit matrix; } \alpha \text{ is a sufficiently large positive number, } 10^5 \text{ or so is chosen)} \tag{11}$$

$$\bar{x}_N = \bar{x}_{N-1} + \frac{P_{N-1}z_N}{1+z_N^T P_{N-1} z_N}\left(y_N - z_N^T \bar{x}_{N-1}\right) \tag{12}$$

$$P_N = P_{N-1} - \frac{P_{N-1}z_N z_N^T P_{N-1}}{1+z_N^T P_{N-1} z_N} \tag{13}$$

Next will be described the method by which the ducting resistance coefficient is identified. The following equation 14 represents the relationship between the air flow rate and the full pressure of the fan 122*a:*

$$\Delta P=p(Q_1+Q_2+Q_3) \tag{14}$$

$Q_{\alpha 2}$: Flow rate of the discharge air from the VAV unit 182*a*

$Q_{\alpha 3}$: Flow rate of the discharge air from the VAV unit 183*a*

$Q_{\alpha 2}$: Flow rate of the discharge air from the VAV unit 184*a*

ΔP: Full pressure of the fan 122*a*

The equation 14 gives an approximate curve of the fan 122*a* figured out by the method of least squares using the test certificate of the fan. As the air flow rate and the full pressure of the fan 122*a* are proportional to the frequency of the inverter 134*a* linearly and quadratically, respectively, when the frequency of the inverter 134*a* is altered the relationship of the following equation 15 will result:

$$\Delta P=f_{34\alpha}{}^2 p((Q_{\alpha 1}+Q_{\alpha 2}+Q_{\alpha 3})/f_{34\alpha}) \tag{15}$$

$f_{34\alpha}$: Frequency of the inverter 134*a*

Regarding the duct route when the dampers of VAV units are fully opened, the following equations 16 through 21 hold:

$$R_{\alpha 1}(Q_{\alpha 1}+Q_{\alpha 2}+Q_{\alpha 3}-Q_{\alpha 0})^2+R_{\alpha 2}(Q_{\alpha 1}+Q_{\alpha 2}+Q_{\alpha 3})^2+R_{\alpha 4}Q_{\alpha 1}{}^2+\Delta P_{01}= f_{34\alpha}{}^2 p((Q_{\alpha 1}+Q_{\alpha 2}+Q_{\alpha 3})/f_{34\alpha}) \tag{16}$$

$Q_{\alpha 0}$: Air flow rate of the VAV unit 181*a*

$R_{\alpha 1}$: Duct resistance coefficient from the rooms 125*a*, 126*a* and 127*a* to the point 402

$R_{\alpha 2}$: Duct resistance coefficient from the point 402 to the point 403

$$R_{\alpha 1}(Q_{\alpha 1}+Q_{\alpha 2}+Q_{\alpha 3}-Q_{\alpha 0})^2+R_{\alpha 2}(Q_{\alpha 1}+Q_{\alpha 2}+Q_{\alpha 3})^2+R_{\alpha 3}(Q_{\alpha 2}+Q_{\alpha 3})^2+ R_{\alpha 5}Q_{\alpha 2}{}^2+\Delta P_{01}$$

$$=f_{34\alpha}{}^2 p((Q_{\alpha 1}+Q_{\alpha 2}+Q_{\alpha 3})/f_{34\alpha}) \tag{17}$$

$$R_{\alpha 1}(Q_{\alpha 1}+Q_{\alpha 2}+Q_{\alpha 3}-Q_{\alpha 0})^2+R_{\alpha 2}(Q_{\alpha 1}+Q_{\alpha 2}+Q_{\alpha 3})^2+R_{\alpha 3}(Q_{\alpha 2}+Q_{\alpha 3})^2+ R_{\alpha 6}Q_{\alpha 3}{}^2+\Delta P_{01}$$

$$=f_{34\alpha}{}^2 p((Q_{\alpha 1}+Q_{\alpha 2}+Q_{\alpha 3})/f_{34\alpha}) \tag{18}$$

$$R_{\alpha 0}Q_{\alpha 0}{}^2+R_{\alpha 2}(Q_{\alpha 1}+Q_{\alpha 2}+Q_{\alpha 3})^2+R_{\alpha 4}Q_{\alpha 1}{}^2+\Delta P_{02}$$

$$=f_{34\alpha}{}^2 p((Q_{\alpha 1}+Q_{\alpha 2}+Q_{\alpha 3})/f_{34\alpha}) \tag{19}$$

$R_{\alpha 5}$: Duct resistance coefficient from the point 401 to the point 402 when the damper of the VAV unit 181*a* is fully opened $$R_{\alpha 0}Q_{\alpha 0}{}^2+R_{\alpha 2}(Q_{\alpha 1}+Q_{\alpha 2}+Q_{\alpha 3})^2+R_{\alpha 3}(Q_{\alpha 2}+Q_{\alpha 3})^2+R_{\alpha 5}Q_{\alpha 2}{}^2+\Delta P_{02}= f_{34\alpha}{}^2 p((Q_{\alpha 1}+Q_{\alpha 2}+Q_{\alpha 3})/f_{34\alpha}) \tag{20}$$

$$R_{\alpha 0}Q_{\alpha 0}{}^2+R_{\alpha 2}(Q_{\alpha 1}+Q_{\alpha 2}+Q_{\alpha 3})^2+R_{\alpha 3}(Q_{\alpha 2}+Q_{\alpha 3})^2+R_{\alpha 6}Q_{\alpha 3}{}^2+\Delta P_{02}= f_{34\alpha}{}^2 p((Q_{\alpha 1}+Q_{\alpha 2}+Q_{\alpha 3})/f_{34\alpha}) \tag{21}$$

Now, the equations 16 through 21 are rearranged into the following equations 22 and 23.

$$x=[R_{\alpha 0}, R_{\alpha 1}, R_{\alpha 2}, R_{\alpha 3}, R_{\alpha 4}, R_{\alpha 5}, R_{\alpha 6}, \Delta P_{01}, \Delta P_{02}]^T \tag{22}$$

$$y=z^T x \tag{23}$$

With the combination of VAV units whose dampers are fully opened and the frequency of the inverter 134*a* being varied, their air flow rates are respectively measured with the flow meters of the VAV units 181*a*, 182*a*, 183*a* and 184*a* and the flow meter 162*a*. Then, on the basis of the measured data, the resistance coefficient of each duct is figured out by the method of least squares (according to the equations 10 through 13). The resistance coefficients of the ducts of the air conditioner 119*b* line are similarly figured out.

By finding out simulation parameters including the resistance coefficients of piping, ducting and so forth by using measurements by sensors, it is made possible to reduce computation errors of the simulation of the air conditioning plant performed by the air conditioning plant simulator 203 and to enhance the performances of VAV control and VWV control.

Next will be described a method of identifying parameters where the pumping test certificate of the low/high-temperature heat transfer medium pump is not available. In the absence of the pumping test certificate of the low/high-temperature heat transfer medium pump, the delivery flow rate versus the total head performance of the pump is approximated with an appropriate function, such as the following equation 24:

$$H=h(Q)=A_2Q^2+A_1Q+A_0 \tag{24}$$

While the function used here is quadratic, an appropriate function that can approximate the delivery flow rate versus the total head performance of the pump should be thought out and chosen. A cubic function or a quartic function may be used for the fan. If the frequency of the inverter 133 is altered, the following equation 25 will hold:

$$H=(f_{33}/50)^2 h(50Q/f_{33})=A_2Q^2+A_1(f_{33}/50)Q+A_0(f_{33}/50)^2 \tag{25}$$

Where the parameter is defined as expressed in the following equation 26:

$$B=R_0-A_2, \tag{26}$$

the following equation 27 will hold with a low/high-temperature heat transfer medium channel on which the flow rate control valve of the VWV unit is fully opened:

$$B(Q_1+Q_2+Q_3)^2-A_1(f_{33}/50)(Q_1+Q_2+Q_3)-A_0(f_{33}/50)^2+R_iQ_i{}^2+H_0= 0(1\leqq i\leqq 3) \tag{27}$$

Then, the equation 27 is rearranged into the following equations 28 and 29:

$$x=[B, A_1, A_0, R_1, R_2, R_3, H_0]^T \tag{28}$$

$$y=z^T x \tag{29}$$

With the combination of VWV units whose dampers are fully opened and the frequency of the inverter 133 being varied, the flow rate of the low/high-temperature heat transfer medium is measured with the flow meters of the VWV units 171, 172 and 173. Then, on the basis of the measured data, the resistance coefficient of the low/high-temperature heat transfer medium channel is figured out by the method of least squares (according to the equations 10 through 13).

Whereas the parameter identifying method for the delivery flow rate versus the total head performance of the low/high-temperature heat transfer medium pump 116 and the piping resistance coefficient in the absence of a test certificate has been described, a similar procedure can be applied to parameter identification of the delivery flow rate versus the total head performance of the heat discharging/absorbing medium pump 112 and the piping resistance coefficient, and the air flow rate versus the full pressure performance of the fans 122*a* and 122*b* of the air conditioners 119*a* and 119*b* and the ducting resistance coefficient.

Next will be described a case in which a differential pressure sensor for measuring the difference in pressure between the inlet and outlet of the low/high-temperature heat transfer medium pump 116 is provided. In this case, as the left side member of the equation 7 can be measured with this differential pressure sensor, the measurement by this differential pressure sensor is used. In this case, the initial cost is greater, but freedom from fluctuations in the accuracy of the pump test certificate can be ensured. Further in this case, even without a pump test certificate, it is possible to identify parameters in a in which all the resistance coefficient are separated from the performance characteristics of the low/high-temperature heat transfer medium pump 116 (where no pump test certificate of the low/high-temperature heat transfer medium pump 116 is available and no differential pressure sensor is provided, it is only possible to identify parameters B combining the coefficient of the approximate function of the characteristics of the low/high-temperature heat transfer medium pump 116 expressed in the equation 26 and the piping resistance coefficient). Furthermore, where this configuration is used, the relationship between the delivery flow rate and the total head of the low/high-temperature heat transfer medium pump 116 can also be figured out.

Where a differential pressure sensor for measuring the difference in pressure between the inlet and outlet of the heat discharging/absorbing medium pump 112 and a differential pressure sensor for measuring the differences in pressure between the respective inlets and outlets of the fan 122*a* and 122*b* are provided, parameter identification for the piping resistance coefficient of the heat discharging/absorbing medium pump 112 and the ducting resistance coefficients of the fans 122*a* and 122*b* of the air conditioners 119*a*, 119*b* can be accomplished in the same manner as for the low/high-temperature heat transfer medium pump 116.

Next will be described details of the monitoring/control unit.

Figure 17:
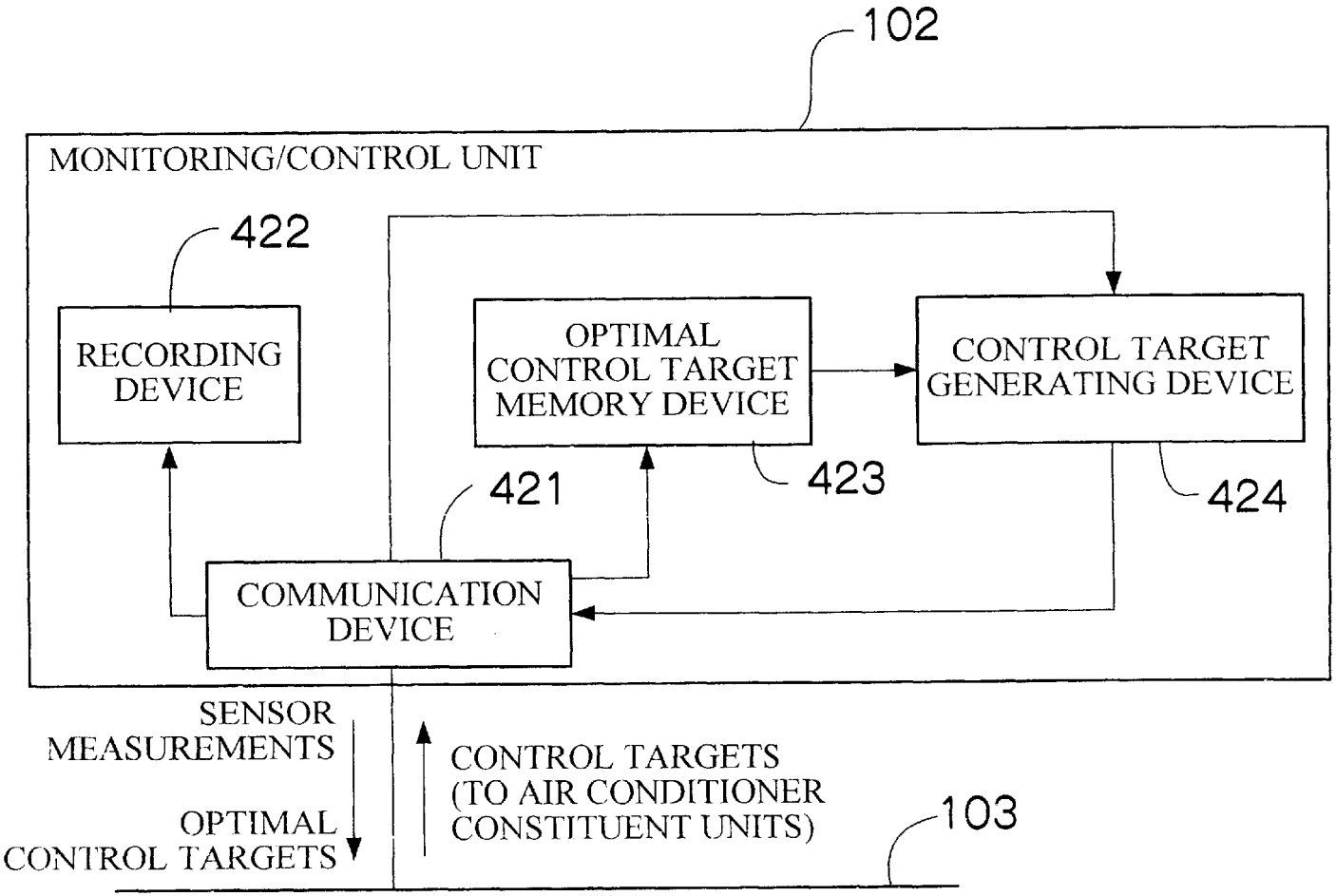
FIG. 17 illustrates the configuration of a monitoring/control unit in the third embodiment of the present invention.

FIG. 17 illustrates a configuration of the monitoring/control unit 102. The monitoring/control unit 102 receives optimal control targets computed by the computer 101 for computing optima and controls the air conditioning plant according to them. The computer 101 for computing optima, as it handles a vast quantity of computation, takes a long time to compute optimal values. As a result, the plant might be unable to response to a sudden change in outside air temperature. The monitoring/control unit 102, which can perform processing in a short cycle, is provided to cope with sudden changes in outside air temperature in controlling the air conditioning plant. Detailed description of the monitoring/control unit 102 will follow.

The monitoring/control unit 102 is provided with a communication device 421 which performs communication with units connected to the communication network 103, a recording device 422 which records data measured by sensors, the operating state of units and control targets instructed to the units, an optimal control target memory device 423 which stores optimal control targets computed by the computer 101 for computing optima, and a control target generating device 424 which, referencing the optimal control targets computed by the computer 101 for computing optima and stored in the optimal control target memory device 423 and monitoring with reference to measurements by sensors or the like to see whether or not the air conditioner is normally processing cooling loads, takes a remedy in any abnormal state that may arise and generates final control targets to be sent to the constituent units of the absorption type low/high-temperature heat generator 114 or the like.

The control target generating device 424 receives new optimal control targets computed by the computer 101 for computing optima and stored in the optimal control target memory device 423, interpolates to prevent abrupt changes from current control targets to new control targets, and send control targets to the air conditioning plant in such a manner that the control targets gradually change.

The control target generating device 424 monitoring with reference to measurements by sensors or the like to see whether or not the air conditioner is normally processing cooling loads, and takes a remedy if any abnormality arises. As the computer 101 for computing optima computes optimal control targets based on the temperature and humidity shortly before, it was found that abrupt change in the temperature and/or humidity of outside air might invite a shortage in the heat discharging/absorbing medium flow rate, the low/high-temperature heat transfer medium flow rate and/or the discharge air flow rate. To prevent such a fault, the control target generating device 424 makes adjustment in accordance with the following rules with reference to the optimal control targets computed by the computer 101 for computing optima.

"If the heat discharging/absorbing medium outlet temperature surpasses its upper limit, the heat discharging/absorbing medium inlet temperature target will be reduced by a predetermined margin and the heat discharging/absorbing medium flow rate will be raised by a predetermined margin"; "if the air flow rate proves still insufficient even though the frequency of the inverter 134*a* of the air conditioner fan 122*a* reaches its maximum, the discharge temperature target will be reduced by a predetermined margin"; or "if the low/high-temperature heat transfer medium flow rate proves still insufficient even though the frequency of the inverter 133 of the low/high-temperature heat transfer medium pump 116 reaches its maximum, the low/high-temperature heat transfer medium temperature target will be reduced by a predetermined margin". In the control target generating device 424, situations and corresponding remedies are stated in such an IF-THEN pattern, so that faults due to changes in situation can be appropriately addressed.

As the monitoring/control unit 102 performs no optimizing computation involving a large quantity of computations and performs control in accordance with the simple rules stated above, its processing period can be kept short. For this reason, it can promptly and safely respond to abrupt changes in situation. If any abrupt change in situation does occur, as the monitoring/control unit 102 makes adjustments to changes in load condition or the like mainly with reference to optimal control targets computed by the computer 101 for computing optima, it makes possible control the air conditioning plan in accordance with quasi-optimal control targets, if not truly optimal control targets.

Although in the above-described mode of implementing the present invention there are one line of the absorption type low/high-temperature heat generator on the low/high-temperature heat transfer medium producing side and two lines of air conditioners on the load side, the number of lines is not limited on either of the low/high-temperature heat transfer medium product side or the consuming side, but there can be any number of lines. Further, instead of the absorption type low/high-temperature heat generator 114, a low/high-temperature heat generator of any other appropriate type can be used, such as a turbo low/high-temperature heat generator or a screw chiller, or an absorption type heat discharging/absorbing medium machine which also permits space heating. Also, instead of the air conditioners 119*a* and 119*b*, fan coil units or some other heat exchangers can be used.

Further, while inverters are used in the above-described embodiments for varying the flow rates of the heat discharging/absorbing medium pump 112, the low/high-temperature heat transfer medium pump 116 and the fans 122*a* and 122*b*, the flow rates can as well be controlled by varying the revolutions with speed change gears. Alternatively, the flow rates can also be varied by using flow rate control valves, dampers, VWV units or VAV units. In this case, the operating cost would be higher than where inverters are used, but the initial cost can be reduced.

As hitherto described, according to the present invention, so that an air conditioning plant can be operated in the most desirable state, the setpoints of the draft temperature of least one air conditioner, the low/high-temperature heat transfer medium temperature of a low/high-temperature heat generator and the temperature of the heat discharging/absorbing medium from a heat source/sink can be optimized. Thus, the inventors of the present invention discovered that the air conditioning plant could be operated in a highly desirable state by controlling these three parameters. This makes possible simple and prompt accomplishment of efficient operation of the air conditioning plant. In addition, a practical air conditioning facility which permits operation of a refrigerating/air conditioning plant in the optimal way so as to minimize the total operating cost of the whole air conditioning plant.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A control method of an air conditioning plant comprising:

providing at least one air conditioner;

providing a low/high-temperature heat generator which supplies a low/high-temperature heat transfer medium to the at least one air conditioner; and providing a cooling tower which supplies a heat discharging/absorbing medium to the low/high-temperature heat generator, wherein setpoints of at least draft temperature of the at least one air conditioner, low/high-temperature heat transfer medium temperature of the low/high-temperature heat generator, temperature of the heat discharging/absorbing medium from the cooling tower, a draft air flow rate of the at least one air conditioner, a flow rate of the low/high-temperature heat transfer medium of the low/high-temperature heat generator, and the flow rate of the heat discharging/absorbing medium from the cooling tower are optimized so as to reduce at least one of energy consumption, operating cost and carbon dioxide emission of the air conditioning plant within extent of satisfying set conditions of air conditioning.

2. The control method as set forth in claim 1, wherein a data table showing a plurality of combinations of the conditions of the draft temperature of the at least one air conditioner, the low/high-temperature heat transfer medium temperature of the low/high-temperature heat generator and the temperature of the heat discharging/absorbing medium from the cooling tower and the at least one of the energy consumption, the operating cost and the carbon dioxide emission of the air conditioning plant at the time is prepared in advance, and setpoints are altered by accessing the data table.

3. A control method of an air conditioning plant comprising:

providing at least one air conditioner;

providing a low/high-temperature heat generator which supplies a low/high-temperature heat transfer medium to the at least one air conditioner; and providing a cooling tower which supplies a heat discharging/absorbing medium to the low/high-temperature heat generator, wherein setpoints of at least draft temperature of the at least one air conditioner, low/high-temperature heat transfer medium temperature of the low/high-temperature heat generator, temperature of the heat discharging/absorbing medium from the cooling tower are optimized so as to reduce at least one of energy consumption, operating cost and carbon dioxide emission of the air conditioning plant within extent of satisfying set conditions of air conditioning; and wherein piping conditions of the at least one air conditioner, piping conditions of the low/high-temperature heat generator and piping conditions of the cooling lower are enterable.

4. An air conditioning plant, comprising:

at least one air conditioner;

a low/high-temperature heat generator which supplies a low/high-temperature heat transfer medium to the at least one air conditioner; and a cooling tower which supplies a heat discharging/absorbing medium to the low/high-temperature heat generator, wherein setpoints of at least draft temperature of the at least one air conditioner, low/high-temperature heat transfer medium temperature of the low/high-temperature heat generator, temperature of the heat discharging/absorbing medium from the cooling tower, a draft air flow rate of the at least one air conditioner, a flow rate of the low/high-temperature heat transfer medium of the low/high-temperature heat generator, and the flow rate of the heat discharging/absorbing medium front the cooling tower are capable of being optimized so as to reduce at least one of energy consumption, operating cost and carbon dioxide emission of the air conditioning plant within extent of satisfying set conditions of air conditioning.

5. A control method of an air conditioning plant comprising:

providing at least one air conditioner;

providing at least one low/high-temperature heat generator which supplies a low/high-temperature heat transfer medium to the at least one air conditioner;

providing a cooling tower which cools or heats the at least one low/high-temperature heat generators;

providing a low/high-temperature heat accumulator which stores the low/high-temperature heat transfer medium during a period of a low low/high-temperature heat load;

providing a heat transfer medium conveying unit such as a pump, a fan and a blower which connects the aforementioned devices;

providing a control unit which controls temperatures of heat generated by the aforementioned devices and/or flow rate of conveying the heat transfer medium;

providing a group of measuring instruments with which data representing the operating states of individual limits including the temperature and the flow rate are measured;

providing a group of control units with which the operation of individual units is controlled; and providing a central monitoring device which is linked by signal lines to the group of measuring instruments and the group of control units, wherein the central monitoring device has, built into it at least one of an air conditioning plant operation simulator which manages the operation of the whole air conditioning plant and an air conditioning plant operational data table; computes on the basis of real time operational data picked up by the measuring instruments the optimal operating temperature and the optimal flow rate for the constituent units of the air conditioning plant and the optimal number of operating units for at least one of the low/high-temperature heat generator to minimize the energy consumption, operating cost or carbon dioxide emission equivalent or any indicator combining two or more for these factors of the whole air conditioning plant in predetermined ranges of conditions, including the temperature and humidity, of air conditioning, ranges of energy consumption conditions with respect to electric power, fuel, water and so forth, or various permissible areas of condition setting which satisfy the ranges of requirements set by combining these two sets of conditions in a prioritized manner; and supplies those optimal values to the group of control units as control setpoints, and the control unit group generates control signals on the basis of the control setpoints, and supplies the control signals to the constituent units of the air conditioning plant or to the pertinent control units themselves to control at least two of the constituent units of the air conditioning plant at substantially the same time.

6. A control method of an air conditioning plant comprising:

providing at least one air conditioner;

providing at least one low/high-temperature heat generator which supplies a low/high-temperature heat transfer medium to the at least one air conditioner;

providing a cooling tower which cools or heats the low/high-temperature heat generator;

providing a heat transfer medium conveying unit, such as a pump, a fan and a blower which connects the aforementioned devices;

providing a control unit which controls temperatures of heat generated by these devices and/or flow rate of conveying the heat transfer medium;

providing a group of measuring instruments with which data representing the operating states of individual units including the temperature and the flow rate are measured;

providing a group of control units with which the operation of individual units is controlled; and providing a central monitoring device which is linked by signal lines to the group of measuring instruments and the group of control units, wherein the central monitoring device has, built into it, at least one of an air conditioning plant operation simulator which manages the operation of the whole air conditioning plant and an air conditioning plant operational data table; computes on the basis of real time operational data picked up by the measuring instruments the optimal operating temperature and the optimal flow rate for the constituent units of the air conditioning plant and the optimal number of operating units of at least one of the low/high-temperature heat generator to minimize the energy consumption, operating cost or carbon dioxide emission equivalent or any indicator combining two or more of these factors of the whole air conditioning plant in predetermined ranges of conditions, including the temperature and humidity, of air conditioning, ranges of energy consumption conditions with respect to electric power, fuel, water and so forth, or various permissible areas of condition setting which satisfy the ranges of requirements set by combining these two sets of conditions in a prioritized manner; and supplies those optimal values to the group of control units as control setpoints, and the control unit group generates control signals on the basis of the control setpoints, and supplies the control signals to the constituent units of the air conditioning plant or to the pertinent control units themselves to control at least two of the constituent units of the air conditioning plant at substantially the same time.

7. The control method as set forth in claim 6, wherein the central monitoring device has a device which enters from outside the priority or the indicator to be minimized and, on the basis of the external input and the various permissible areas of condition setting, controls the minimizing computation, the generation of the optimal control values and at least two of the constituent units of the air conditioning plant at substantially the same time.

8. The control method as set forth in claim 6, wherein the central monitoring device is provided in at least one of the units having devices which externally supply and display the energy consumption, the operating cost and the instantaneous value and the integrated value of the carbon dioxide emission equivalent of the whole of the air conditioning plant.

9. An air conditioning plant which performs air conditioning by supplying a low/high-temperature heat transfer medium in a circulatory manner, comprising:

simulation models of low/high-temperature heat generators, pumps and other units constituting the air conditioning plant, wherein optimal control targets to minimize or maximize a performance criterion are determined by simulation, and the air conditioning plant is operated according to the optimal control targets;

a computer for computing optima, which determines optimal control targets to minimize or maximize a performance criterion by simulation; and a monitoring/control unit which receives optimal control targets from the computer for computing optima and performs monitoring and control to ensure that constituent units of the air conditioning plant operate without abnormality, wherein the processing period of the monitoring control unit is shorter than that of the computer for computing optima and the monitoring/control unit adjusts the control targets, in response to variations in the conditions of outside air, the temperature of cooling water, that of cold water and other factors, so that the operational limits of the units be not surpassed with reference to the optimal control targets determined by the computer for computing optima.

10. An air conditioning plant which performs air conditioning by supplying a low/high-temperature heat transfer medium in a circulatory manner, comprising:

an equipment characteristics database which stores characteristics data on constituent units of the air conditioning plant, an air conditioning plant simulator which computes power consumptions and fuel consumptions in partial loads from the equipment characteristics data of constituent units stored in the equipment characteristics database, and computes performance functions by using conversion coefficients; and an optimizing device which computes the optimal control targets for the constituent units of the air conditioning plant by using the air conditioning plant simulator, wherein the constituent units of the air conditioning plant are operated according to the optimal control targets.

11. The air conditioning plant as set forth in claim 10, further comprising:

a computer for computing optima, which determines optimal control targets to minimize or maximize a performance criterion by simulation; and a monitoring/control unit which receives optimal control targets from the computer for computing optima and performs monitoring and control to ensure that constituent units of the air conditioning plant operate without abnormality, wherein the processing period of the monitoring/control unit is shorter than that of the computer for computing optima, and the monitoring/control unit adjusts the control targets, in response to variations in the conditions of outside air, the temperature of cooling water, that of cold water and other factors, so that the operational limits of the units be not surpassed with reference to the optimal control targets determined by the computer for computing optima.

12. The air conditioning plant as set forth in claim 10, wherein parameters required for air conditioning plant simulation by the air conditioning plant simulator are identified on the basis of measurements by sensors, the air conditioning plant is simulated using the identified parameters, and the parameters to be identified are the resistance coefficients of piping and ducting.

* * * * *